US009474359B2

(12) United States Patent
Lopez et al.

(10) Patent No.: US 9,474,359 B2
(45) Date of Patent: Oct. 25, 2016

(54) BODY CLEANSING APPARATUS

(76) Inventors: Kenneth Oscar Lopez, Chicago, IL (US); Astute Maria Aurilla, Chicago, IL (US)

( * ) Notice: Subject to any disclaimer, the term of this patent is extended or adjusted under 35 U.S.C. 154(b) by 636 days.

(21) Appl. No.: 13/536,937

(22) Filed: Jun. 28, 2012

(65) Prior Publication Data

US 2013/0000660 A1 Jan. 3, 2013

Related U.S. Application Data

(60) Provisional application No. 61/501,897, filed on Jun. 28, 2011.

(51) Int. Cl.

| | |
|---|---|
| ***A46B 5/04*** | (2006.01) |
| ***A46B 11/02*** | (2006.01) |
| ***A46B 9/02*** | (2006.01) |
| ***A46D 1/00*** | (2006.01) |
| *A46B 11/00* | (2006.01) |

(52) U.S. Cl.

CPC ..... *A46B 9/026* (2013.01); *A46D 1/0253* (2013.01); *A46D 1/0292* (2013.01); *A46B 11/002* (2013.01); *A46B 2200/102* (2013.01); *B65D 2101/0015* (2013.01)

(58) Field of Classification Search

CPC .. A46B 5/04; A46B 9/026; A46B 2200/102; A46D 1/0253; A46D 1/0292; A61H 7/003

USPC ..... 15/104.92, 186, 187, 188; 132/112, 132/113, 116

See application file for complete search history.

(56) References Cited

U.S. PATENT DOCUMENTS

| | | | | |
|---|---|---|---|---|
| 4,462,413 | A * | 7/1984 | Schmitz | 132/113 |
| 4,958,596 | A * | 9/1990 | Belan | 119/603 |
| 5,311,887 | A * | 5/1994 | Ramsey | 132/114 |
| 6,457,476 | B1 * | 10/2002 | Elmer et al. | 132/114 |
| 6,539,949 | B2 * | 4/2003 | Christensen | 132/114 |
| 6,962,158 | B1 * | 11/2005 | Anguelo | 132/113 |
| 7,153,282 | B1 * | 12/2006 | Dudley | 601/93 |
| 2005/0138745 | A1 * | 6/2005 | Huang | 15/187 |
| 2005/0257800 | A1 * | 11/2005 | Inoue | 132/114 |
| 2008/0245380 | A1 * | 10/2008 | Ecker et al. | 132/114 |
| 2009/0019719 | A1 * | 1/2009 | Yde et al. | 34/96 |
| 2010/0237104 | A1 * | 9/2010 | Schneider et al. | 222/330 |
| 2012/0118311 | A1 * | 5/2012 | Rose | 132/114 |

FOREIGN PATENT DOCUMENTS

WO WO 2010034802 A1 * 4/2010 ..... A61H 7/00

* cited by examiner

*Primary Examiner* — Michael Jennings
(74) *Attorney, Agent, or Firm* — Ash Tankha; Lipton, Weinberger & Husick

(57) ABSTRACT

A body cleansing apparatus including a base member having one or more contoured profiles that conform to a user's body part, and multiple cleansing members is provided. The cleansing members are positioned and attached at multiple locations on the contoured profiles of the base member. Each of one or more of the cleansing members includes a stem and a cluster of flexible bristles. The stem is attached to and extends outwardly from the base member. The flexible bristles curvedly branch outwards from an upper end of the stem and define a reservoir within each cluster for storing, retaining, and releasing a cleansing agent along the flexible bristles when the user's body part contacts and applies pressure on the stem, thereby allowing the user to cleanse the body part. In an embodiment, the cleansing members also include single elongated flexible bristles attached to and extending outwardly from the base member.

9 Claims, 31 Drawing Sheets

BODY CLEANSING APPARATUS

CROSS REFERENCE TO RELATED APPLICATIONS

This application claims the benefit of provisional patent application No. 61/501,897 titled "Cleansing Kit", filed in the United States Patent and Trademark Office on Jun. 28, 2011.

The specification of the above referenced patent application is incorporated herein by reference in its entirety.

BACKGROUND

The apparatus disclosed herein, in general, relates to a cleansing apparatus. More particularly, the apparatus disclosed herein relates to a body cleansing apparatus comprising multiple cleansing members positioned on the body cleansing apparatus for cleansing a user's body.

Commercially available cleansing apparatuses typically include handheld brushes that can be used to cleanse a user's back. However, a user may not be able to easily access all areas of the user's back for cleansing using these handheld brushes. Conventional handheld back brushes that have fixed and detachable handles typically require a fair amount of physical flexibility and coordination on the part of the user for their effective use. Users with stiff necks, stiff backs, etc., typically find it difficult to use these handheld back brushes for cleansing body parts that are difficult to access for example, the user's back.

Moreover, bristles provided on conventional brushing devices have a linear design. These linear bristle structures do not sufficiently collect, contain, retain, and dispense a cleansing agent used for cleansing, resulting in wastage of the cleansing agent.

Hence, there is a long felt but unresolved need for a body cleansing apparatus that is accessible to all areas of the user's back or other body part, without requiring any effort from the user for cleansing such body parts. Furthermore, there is a need for a body cleansing apparatus comprising bristle structures that sufficiently collect, contain, retain, and dispense a cleansing agent for allowing the user to simultaneously brush and cleanse the user's body part.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The apparatus disclosed herein addresses the above mentioned needs for a body cleansing apparatus that is accessible to all areas of a user's back or other body part, without requiring any effort from the user for cleansing such body parts. The body cleansing apparatus disclosed herein comprises cleansing members that sufficiently collect, contain, retain, and dispense a cleansing agent for allowing the user to simultaneously brush and cleanse the user's body part.

The body cleansing apparatus disclosed herein comprises a base member and multiple cleansing members. The base member comprises one or more contoured profiles configured to conform to a user's body part. In an embodiment, the base member is configured to conform to a rear body part of the user, that is, the user's back, neck, shoulders, etc., for cleansing the user's rear body part. The base member configured for cleansing the user's rear body part is detachably attachable to a support structure by one or more fasteners, for example, hook and loop fasteners, suction cups, etc. The cleansing members are positioned and attached at multiple locations on one or more of the contoured profiles of the base member. In an embodiment, one or more of the cleansing members are detachably attachable to one or more of multiple locations on one or more of the contoured profiles of the base member for allowing the user to flexibly configure the cleansing members on the base member for cleansing the user's body part.

Each of one or more of the cleansing members comprises a stem and a cluster of flexible bristles. The stem is attached to and extends outwardly from the base member. The flexible bristles in each cluster curvedly branch outwards from an upper end of the stem and define a reservoir within each cluster. The reservoir is configurable for storing and retaining a cleansing agent and releasing the cleansing agent along the flexible bristles when the user's body part contacts and applies pressure, for example, on the stem. Each cluster of flexible bristles comprises a central flexible bristle extending from the upper end of the stem, and radial flexible bristles surrounding the central flexible bristle. In an embodiment, each of one or more of the flexible bristles in a cluster comprises one or more apertures positioned on a body of each of the flexible bristles. The apertures are configured to dispense the cleansing agent contained within the stem.

In an embodiment, each of one or more of the flexible bristles in the cluster comprises a spoon section that defines the reservoir. The spoon section is configured to collect and retain the cleansing agent for cleansing the user's body part. In another embodiment, each of one or more of the cleansing members comprises one or more generally concave troughs positioned at a base of each of the flexible bristles in a cluster where each of the flexible bristles meets the stem of each of the cleansing members. The generally concave troughs are configured to contain the cleansing agent. In another embodiment, each of one or more of the flexible bristles in the cluster is configured in a wide generally concave configuration that defines the reservoir. The flexible bristles in the wide generally concave configuration are configured to collect and retain the cleansing agent for cleansing the user's body part.

In an embodiment, the base member further comprises a bladder configured to store and contain the cleansing agent. The stored cleansing agent is drawn from the bladder through the stem and out through one or more apertures positioned on the body of each of one or more of the flexible bristles in the cluster, when the user's body part contacts and applies a pressure on the stem, for dispensing the cleansing agent. The stem of each of the cleansing members comprises a cavity, in fluid communication with the bladder defined within the base member, for extracting the cleansing agent stored in the bladder, containing, and dispensing the cleansing agent through one or more apertures positioned on the body of each of one or more of the flexible bristles in the cluster for cleansing the user's body part, when the user's body part contacts and applies pressure on the stem.

In an embodiment, one or more of the cleansing members are single elongated flexible bristles attached to and extending outwardly from the base member. In an embodiment, each of the flexible bristles comprises a flexible tip configured to contact and cleanse the user's body part. In another embodiment, the body cleansing apparatus disclosed herein further comprises a spring member operably connected to a lower end of the stem of each of the cleansing members for enabling the flexible movement of each of the cleansing members during cleansing of the body part. The flexible bristles coated with the cleansing agent allow the user to cleanse the body part when the body part contacts and applies pressure on the flexible bristles.

In an embodiment, the body cleansing apparatus is rollably wrapped around spaced apart elongate rods having elongate rollers. A motor drives the lower elongate roller via a belt driven wheel assembly, which is operably connected to the lower elongate roller for rolling the body cleansing apparatus over the elongate rollers and enhancing the cleansing of the user's body part.

In an embodiment, the base member is configured as a wearable unit that conforms to the user's hand. The wearable unit comprises a chamber for accommodating the user's hand. In an embodiment, the body cleansing apparatus disclosed herein further comprises an insert member extending outwardly from the wearable unit and containing the cleansing agent. The insert member containing the cleansing agent is foldable into the chamber of the wearable unit. The user inserts the hand into the chamber of the wearable unit and folds the insert member containing the cleansing agent into the chamber of the wearable unit for cleansing the user's body by release of the cleansing agent through the wearable unit. The wearable unit is selectively composed of a scrubbing material. The cleansing agent permeates through the scrubbing material of the wearable unit for cleansing the user's body.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and components disclosed herein.

DETAILED DESCRIPTION OF THE INVENTION

Figure 1:
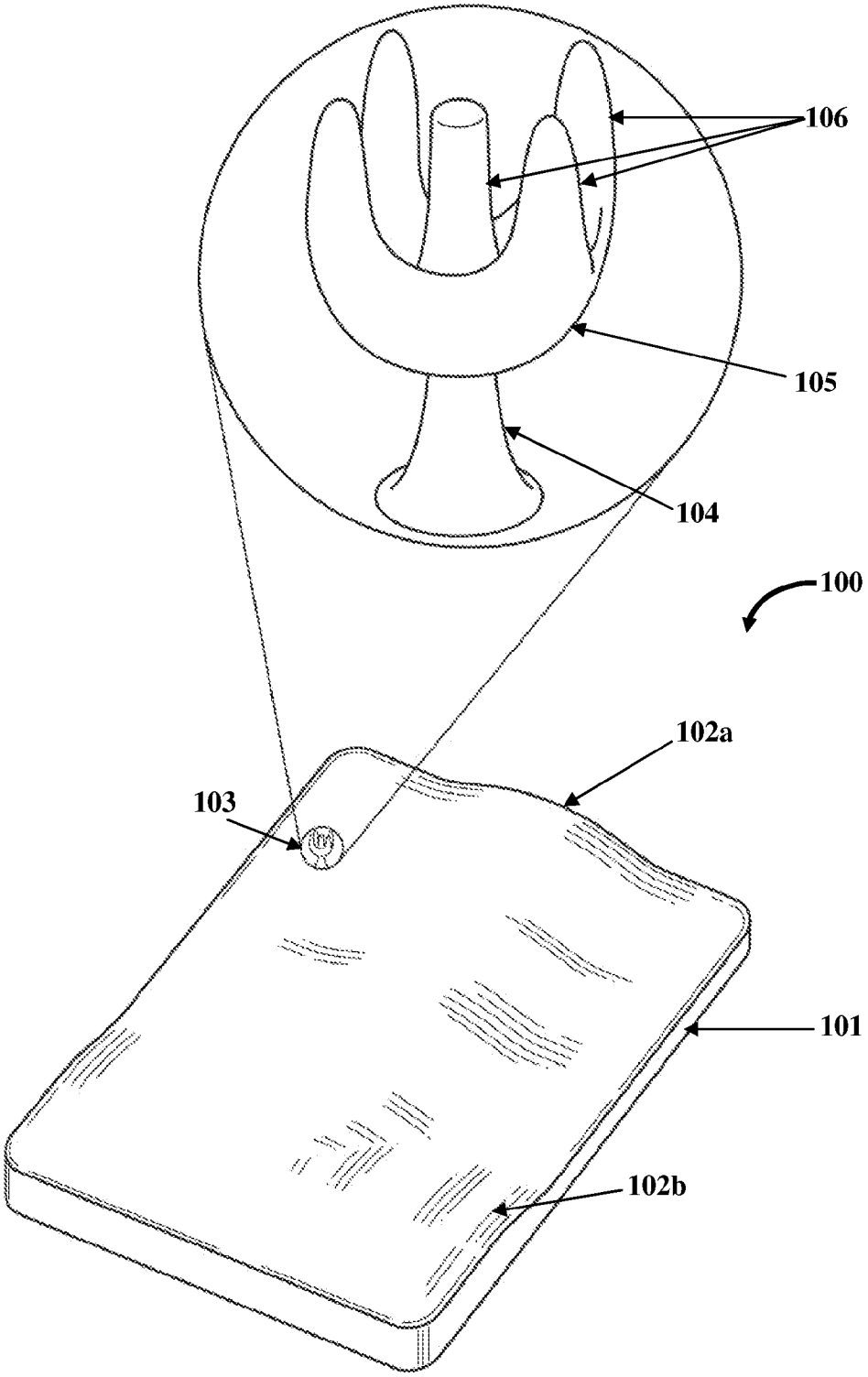
FIG. 1 exemplarily illustrates a front isometric view of a body cleansing apparatus, showing a projected enlarged view of one of multiple cleansing members positioned on a base member of the body cleansing apparatus.

FIG. 1 exemplarily illustrates a front isometric view of a body cleansing apparatus 100, showing a projected enlarged view of one of multiple cleansing members 103 positioned on a base member 101 of the body cleansing apparatus 100. The body cleansing apparatus 100 comprises a base member 101 and multiple cleansing members 103 positioned on the base member 101. The base member 101 comprises one or more contoured profiles 102*a* and 102*b* configured to conform to a user's body part, for example, a user's back, neck, shoulders, etc. As exemplarily illustrated in FIGS. 1-2, FIGS. 4-6, FIGS. 10A-10B, FIG. 13, FIG. 17, FIG. 23, and FIGS. 26-28, the base member 101 is, for example, of a generally rectangular shape configured to conform to the user's rear body part and used to cleanse the rear areas of the user's body, for example, the user's back. The base member 101 is, for example, made of a synthetic material, rubber, etc. In an embodiment, the base member 101 is backed with a foam material. A contoured profile 102*a*, for example, a spongy generally concave shaped hump at the center of the base member 101 is configured to the contour of the user's rear body part, for example, to a posterior curvature of the user's back. In an embodiment, the contoured profiles 102*a* and 102*b* of the base member 101 are customizable to any specific part or curvature of a user's rear body part. The contoured profiles 102*a* and 102*b* of the base member 101 taper downwardly to direct water, the cleansing agent 1001 exemplarily illustrated in FIG. 10A, FIG. 10C, FIG. 11, FIG. 12B, FIG. 13, and FIGS. 15-16, etc., away from the body cleansing apparatus 100 during cleansing. The cleansing members 103 are positioned and attached at multiple locations on one or more of the contoured profiles 102*a* and 102*b* of the base member 101. The structure of a cleansing member 103 comprising a stem 104 and a cluster 105 of flexible bristles 106 is disclosed in the detailed description of FIG. 7.

Figure 2:
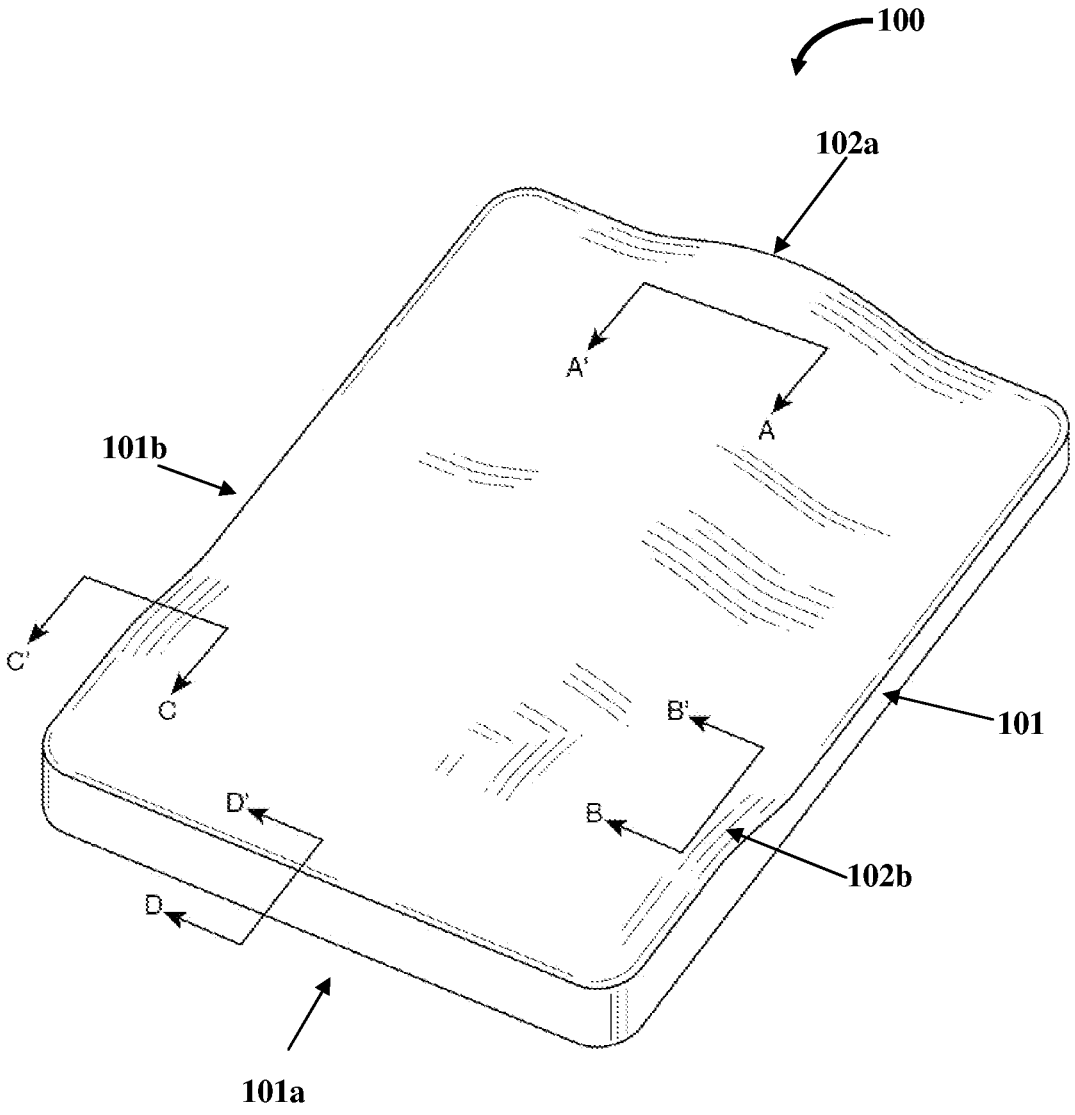
FIG. 2 exemplarily illustrates a front isometric view of the body cleansing apparatus, showing sections taken along multiple contoured profiles of the base member.

FIG. 2 exemplarily illustrates a front isometric view of the body cleansing apparatus 100, showing sections taken along multiple contoured profiles 102*a* and 102*b* of the base member 101. The sections A-A', B-B', C-C', and D-D' of the base member 101 taken along different contoured profiles, for example, 102*a* and 102*b* of the base member 101 are exemplarily illustrated in FIGS. 3A-3D respectively.

Figure 3A:
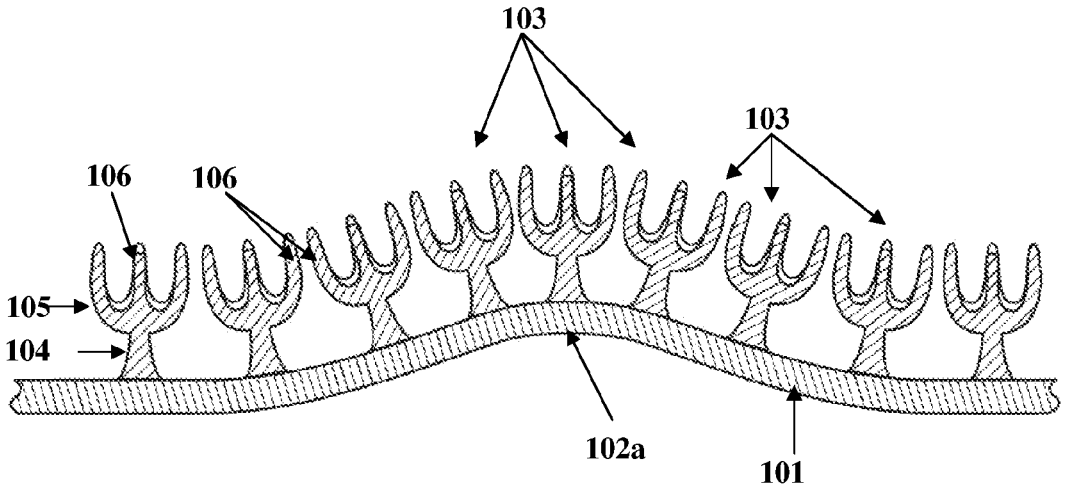
FIG. 3A exemplarily illustrates a sectional view of the body cleansing apparatus taken along section A-A' of FIG. 2.

FIG. 3A exemplarily illustrates a sectional view of the body cleansing apparatus 100 taken along section A-A' of FIG. 2. As exemplarily illustrated in FIG. 3A, the cleansing members 103, each comprising a stem 104 and a cluster 105 of flexible bristles 106, are positioned and attached along the contoured profile 102*a* of the base member 101. The cleansing members 103 along the contoured profile 102*a* configured at the center of the base member 101 follow a contour of the user's back to cleanse the user's back.

Figure 3B:
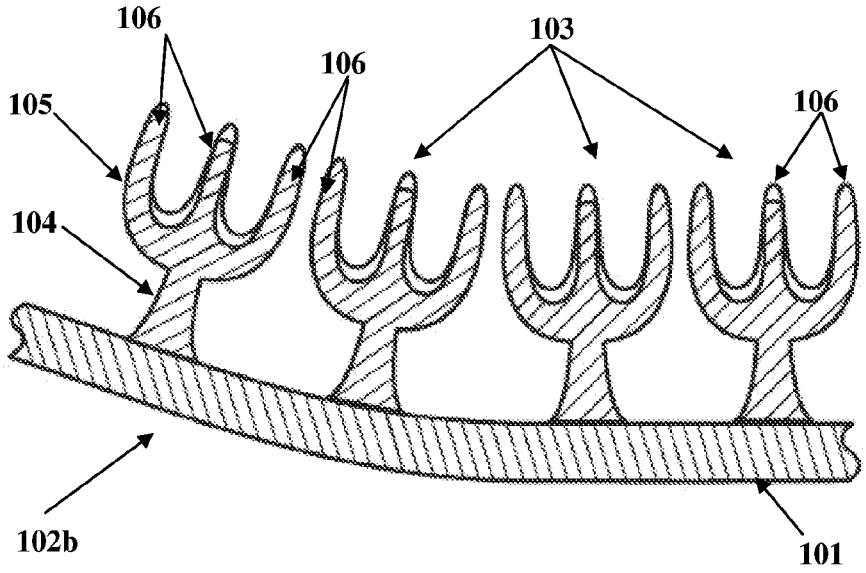
FIG. 3B exemplarily illustrates a sectional view of the body cleansing apparatus taken along section B-B' of FIG. 2.

FIG. 3B exemplarily illustrates a sectional view of the body cleansing apparatus 100 taken along section B-B' of FIG. 2. As exemplarily illustrated in FIG. 3B, the cleansing members 103, each comprising a stem 104 and a cluster 105 of flexible bristles 106, are positioned and attached along the contoured profile 102*b* of the base member 101. The cleansing members 103 along the contoured profile 102*b* configured proximal to the bottom end 101*a* of the base member 101, as exemplarily illustrated in FIG. 2, cleanse the user's lower back. The base member 101 of the body cleansing apparatus 100 tapers downwardly along the contoured profile 102*b* to facilitate removal of the cleansing agent 1001, for example, liquid soap exemplarily illustrated in FIG. 10A, FIG. 10C, FIG. 11, FIG. 12B, FIG. 13, and FIGS. 15-16, and water from the body cleansing apparatus 100, during cleansing.

Figure 3C:
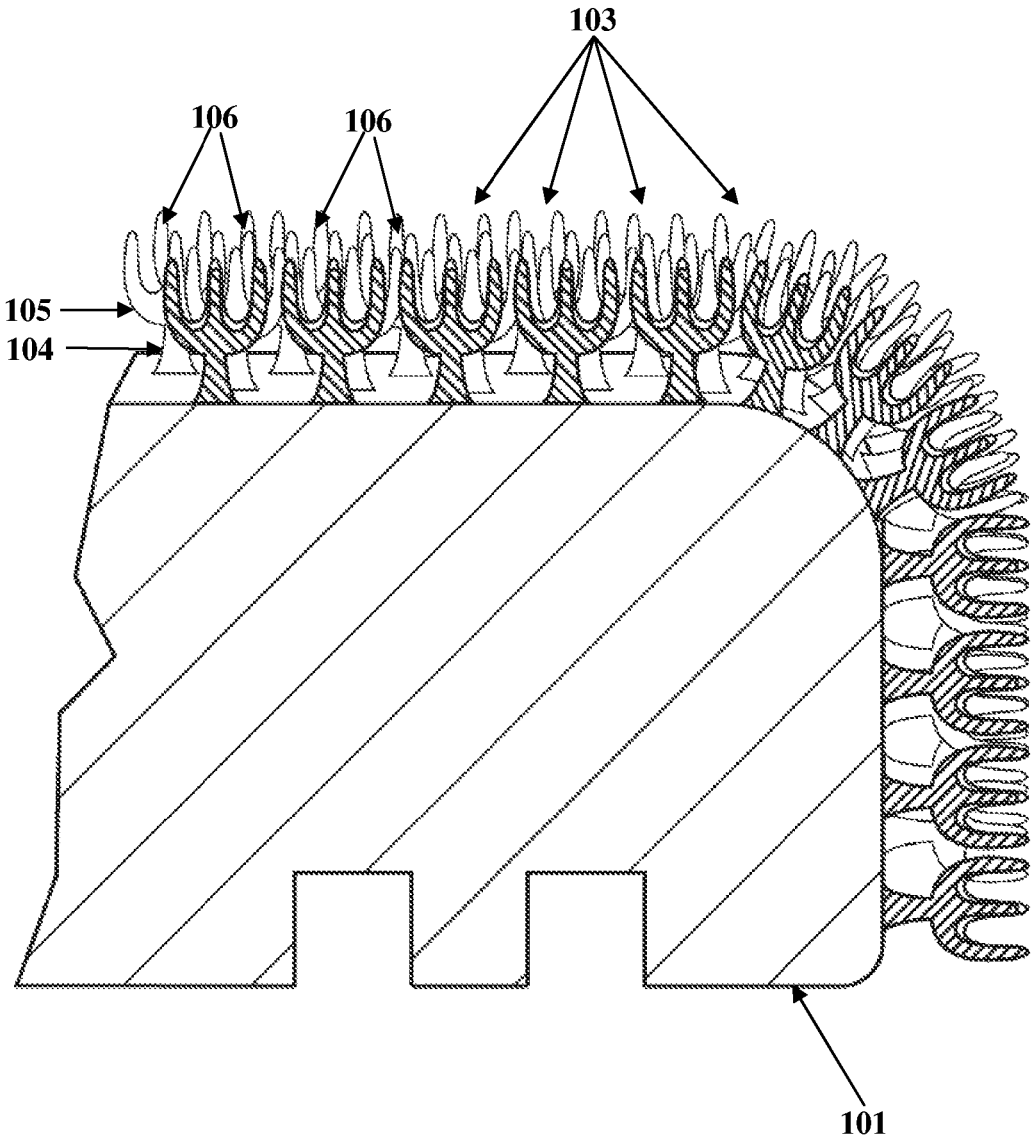
FIG. 3C exemplarily illustrates a sectional view of the body cleansing apparatus taken along section C-C' of FIG. 2.

FIG. 3C exemplarily illustrates a sectional view of the body cleansing apparatus 100 taken along section C-C' of FIG. 2. As exemplarily illustrated in FIG. 3C, the cleansing members 103, each comprising a stem 104 and a cluster 105 of flexible bristles 106, are positioned and attached along the sides 101*b* of the base member 101 as exemplarily illustrated in FIG. 2.

Figure 3D:
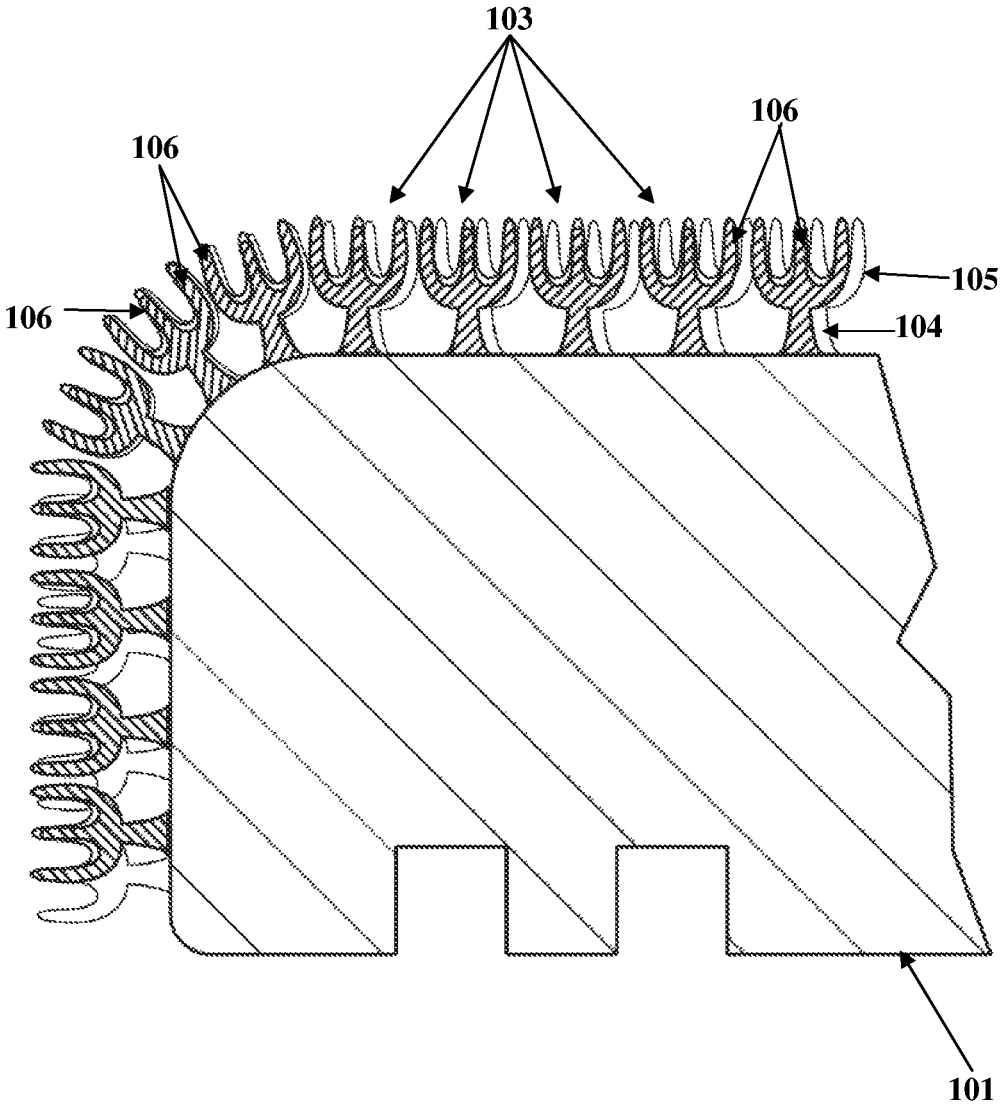
FIG. 3D exemplarily illustrates a sectional view of the body cleansing apparatus taken along section D-D' of FIG. 2.

FIG. 3D exemplarily illustrates a sectional view of the body cleansing apparatus 100 taken along section D-D' of FIG. 2. As exemplarily illustrated in FIG. 3D, the cleansing members 103, each comprising a stem 104 and a cluster 105 of flexible bristles 106, are positioned and attached at the bottom end 101*a* of the base member 101 as exemplarily illustrated in FIG. 2.

Figure 4:
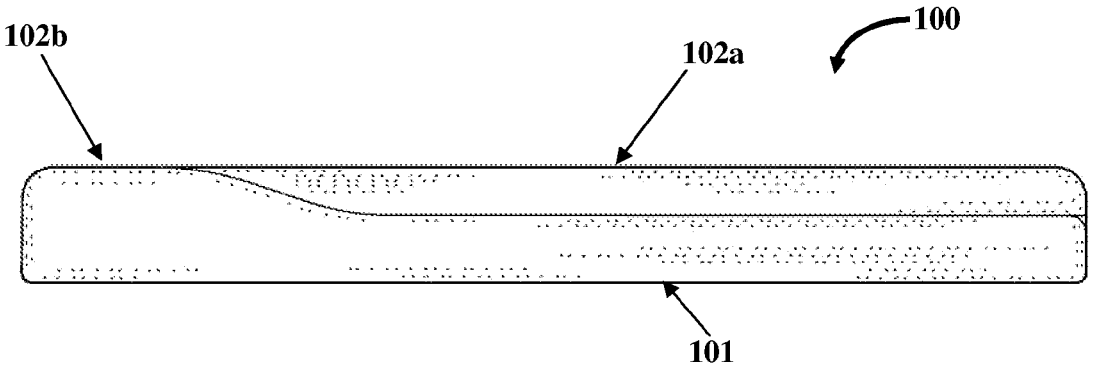
FIG. 4 exemplarily illustrates a right side elevation view of the body cleansing apparatus.
Figure 5:
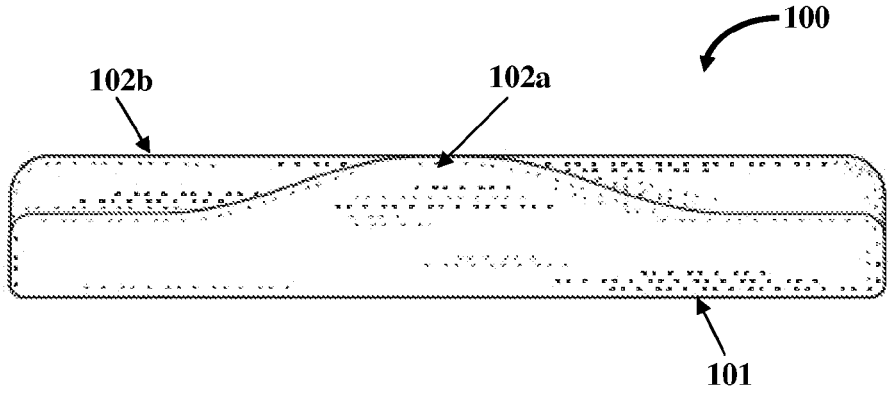
FIG. 5 exemplarily illustrates a top view of the body cleansing apparatus.
Figure 6:
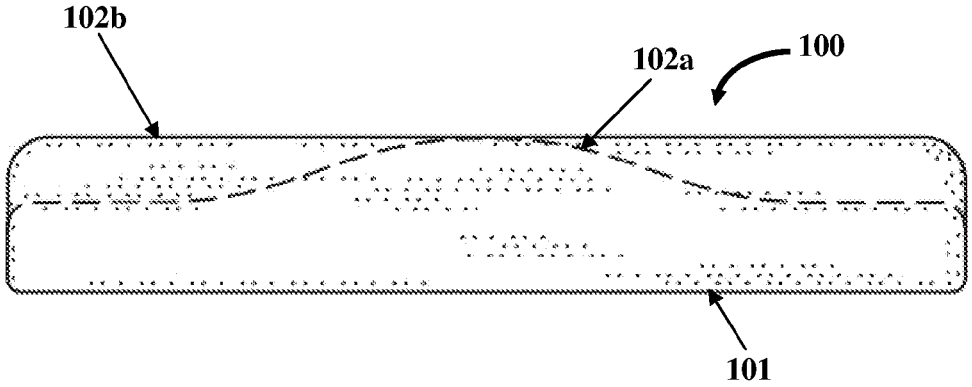
FIG. 6 exemplarily illustrates a bottom view of the body cleansing apparatus.

FIGS. 4-6 exemplarily illustrate a right side elevation view, a top view, and a bottom view respectively, of the body cleansing apparatus 100. The contoured profiles 102*a* and 102*b* of the base member 101 are exemplarily illustrated in FIGS. 4-6.

Figure 7:
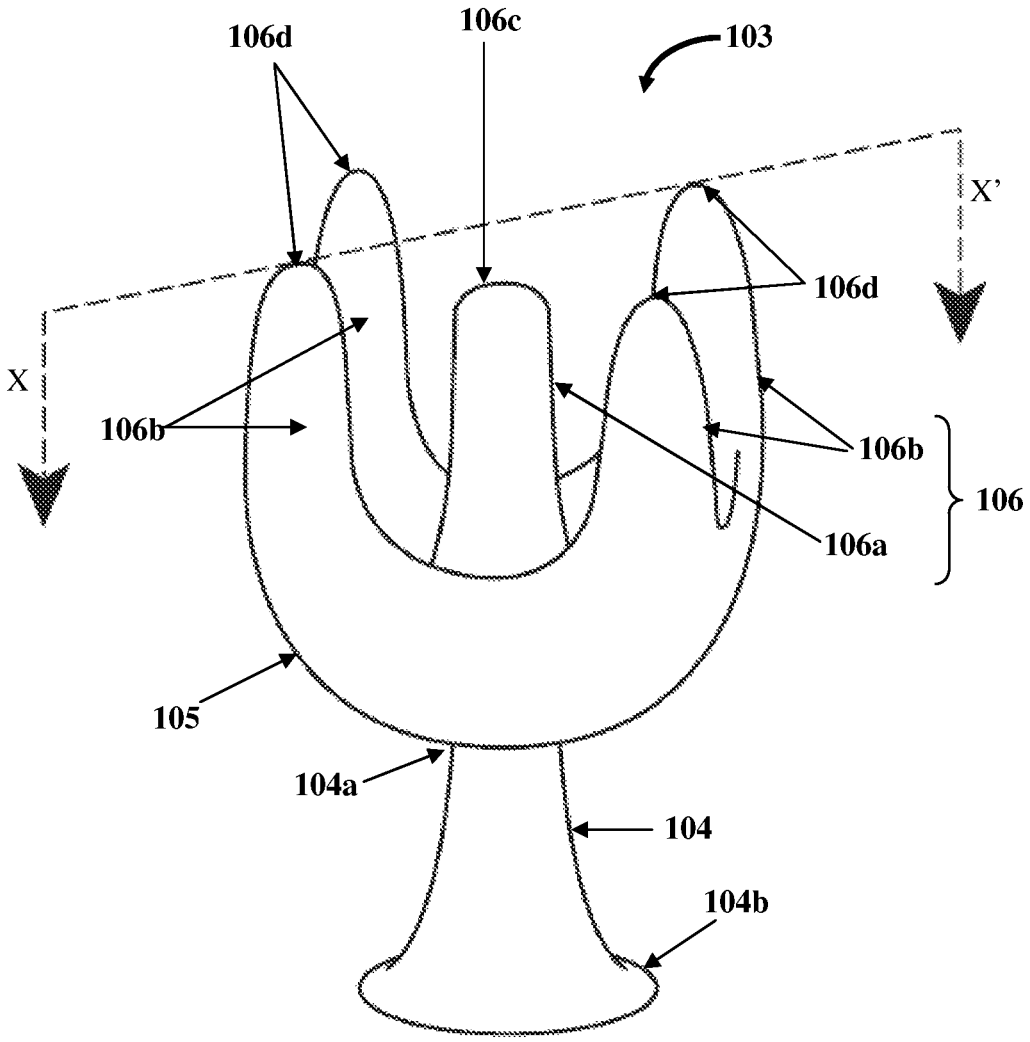
FIG. 7 exemplarily illustrates an isometric view of a cleansing member.

FIG. 7 exemplarily illustrates an isometric view of a cleansing member 103. The cleansing member 103, exemplarily illustrated in FIG. 7, comprises a stem 104 and a cluster 105 of flexible bristles 106. The stem 104 is attached to and extends outwardly from the base member 101 of the body cleansing apparatus 100 as exemplarily illustrated in FIG. 1. The flexible bristles 106 in the cluster 105 curvedly branch outwards from an upper end 104*a* of the stem 104 and define a reservoir 110 within each cluster 105, as exemplarily illustrated in FIGS. 12A-12B, FIG. 13, and FIGS. 15-16. The reservoir 110 prevents the cleansing agent 1001 as exemplarily illustrated in FIG. 12B, FIG. 13, and FIGS. 15-16 from draining out of the cluster 105, thereby preventing wastage of the cleansing agent 1001 during cleansing of the user's body part. The cluster 105 of flexible bristles 106 comprises a central flexible bristle 106*a* extending from the upper end 104*a* of the stem 104, and radial flexible bristles 106*b* surrounding the central flexible bristle 106*a*. The radial flexible bristles 106*b* curvedly branch outwards from the upper end 104*a* of the stem 104. In an embodiment, the radial flexible bristles 106*b* are longer than the central flexible bristle 106*a*. Each cluster 105 may have a configurable number of radial flexible bristles 106*b* surrounding the central flexible bristle 106*a*. In an embodiment, the flexible bristles 106*a* and 106*b* in each cluster 105 taper toward their corresponding tips 106*c* and 106*d* respectively. The flexible bristles 106 grip, for example, the user's back during cleansing. The flexible bristles 106 are, for example, made from a rubber material, a silicone rubber material, or any type of flexible material.

Figure 8:
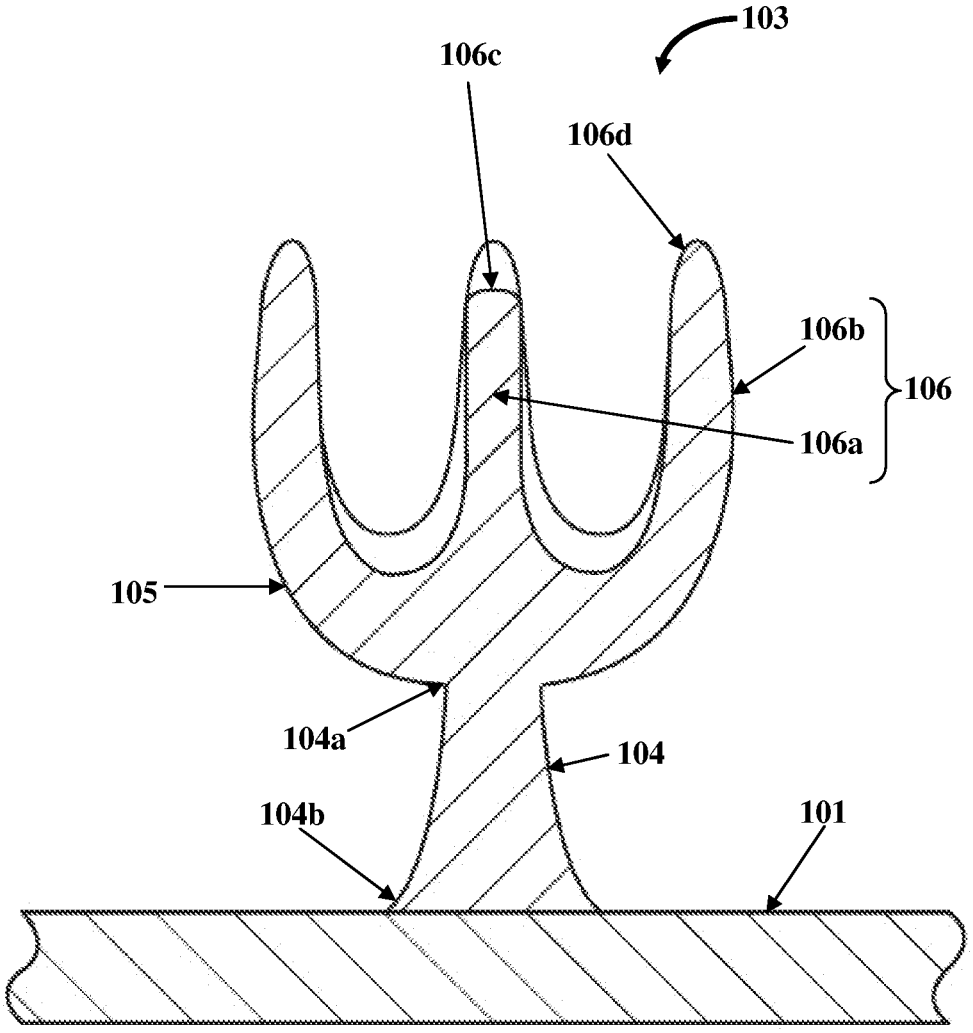
FIG. 8 exemplarily illustrates a sectional view of the cleansing member taken along section X-X' of FIG. 7.

FIG. 8 exemplarily illustrates a sectional view of the cleansing member 103 taken along section X-X' of FIG. 7. The sectional view in FIG. 8 shows the central flexible bristle 106*a* and the radial flexible bristles 106*b* of the cleansing member 103. In an example, a configurable number of clusters 105 of flexible bristles 106 are detachably attached per square inch on the base member 101 and extend approximately one inch away from the base member 101.

Figure 9:
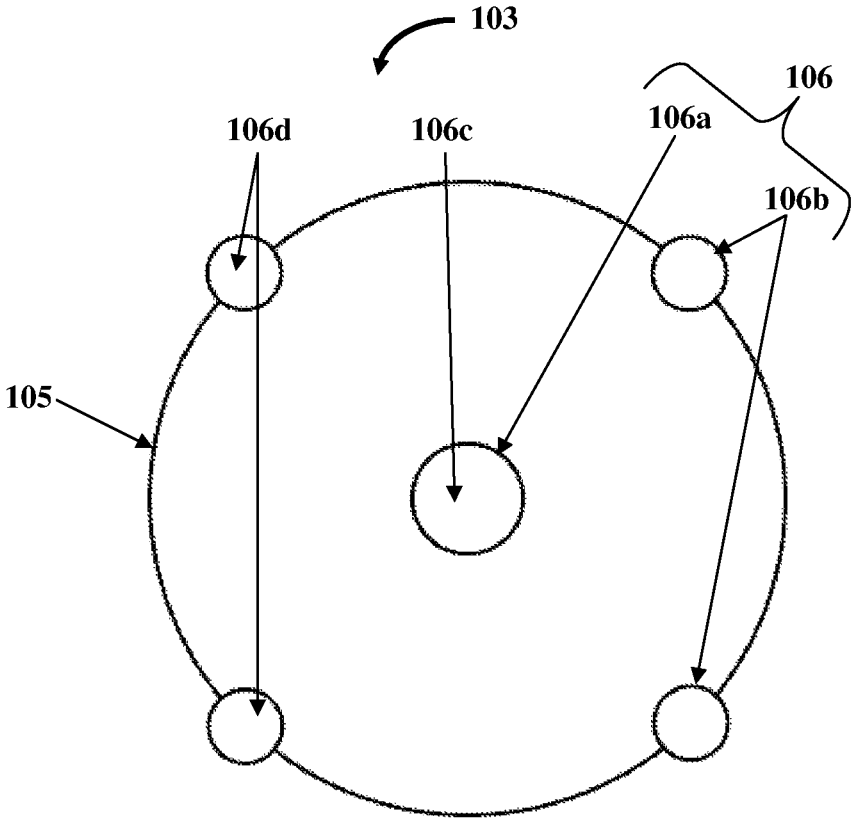
FIG. 9 exemplarily illustrates a top view of the cleansing member.

FIG. 9 exemplarily illustrates a top view of the cleansing member 103. The tips 106*c* and 106*d* of the central flexible bristle 106*a* and the radial flexible bristles 106*b* respectively of the cluster 105 are exemplarily illustrated in FIG. 9. The tip 106*c* of the central flexible bristle 106*a* is broader in comparison with the tips 106*d* of the radial flexible bristles 106*b*. In an embodiment, each of the flexible bristles 106 comprises a flexible tip 106*c* or 106*d* configured to contact and cleanse the user's body part. The flexible tip 106*c* or 106*d* of each of the flexible bristles 106 is, for example, made from a rubber material or any type of flexible material.

Figure 10A:
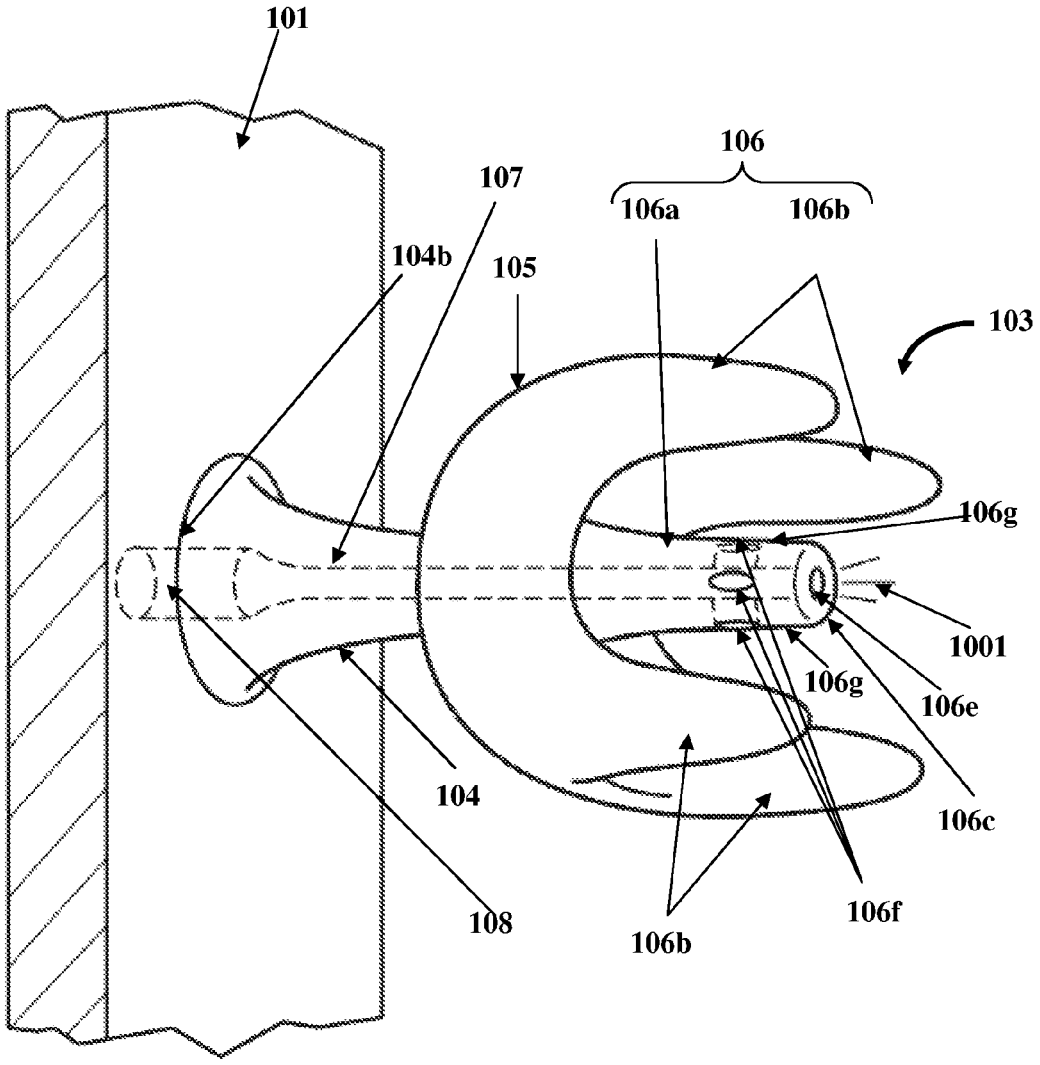
FIG. 10A exemplarily illustrates an enlarged isometric view of an embodiment of the cleansing member attached to the base member of the body cleansing apparatus, where the stem of the cleansing member comprises a cavity, in fluid communication with a bladder that contains a cleansing agent.

FIG. 10A exemplarily illustrates an enlarged isometric view of an embodiment of the cleansing member 103 attached to the base member 101 of the body cleansing apparatus 100 exemplarily illustrated in FIG. 2, where the stem 104 of the cleansing member 103 comprises a cavity 107, in fluid communication with a bladder 108 that contains a cleansing agent 1001. In an embodiment, each of one or more of the flexible bristles 106 in the cluster 105 comprises one or more apertures 106*e* and 106*f* positioned on a body of each of the flexible bristles 106. The apertures 106*e* and 106*f* are configured to dispense the cleansing agent 1001 contained within the stem 104. As exemplarily illustrated in FIG. 10A, the central flexible bristle 106*a* of the cluster 105 comprises an aperture 106*e* on the tip 106*c* of the central flexible bristle 106*a* and additional apertures 106*f* on the sides 106*g* of the central flexible bristle 106*a*. In an embodiment, the base member 101 further comprises a bladder 108 configured to store and contain the cleansing agent 1001.

Figure 10B:
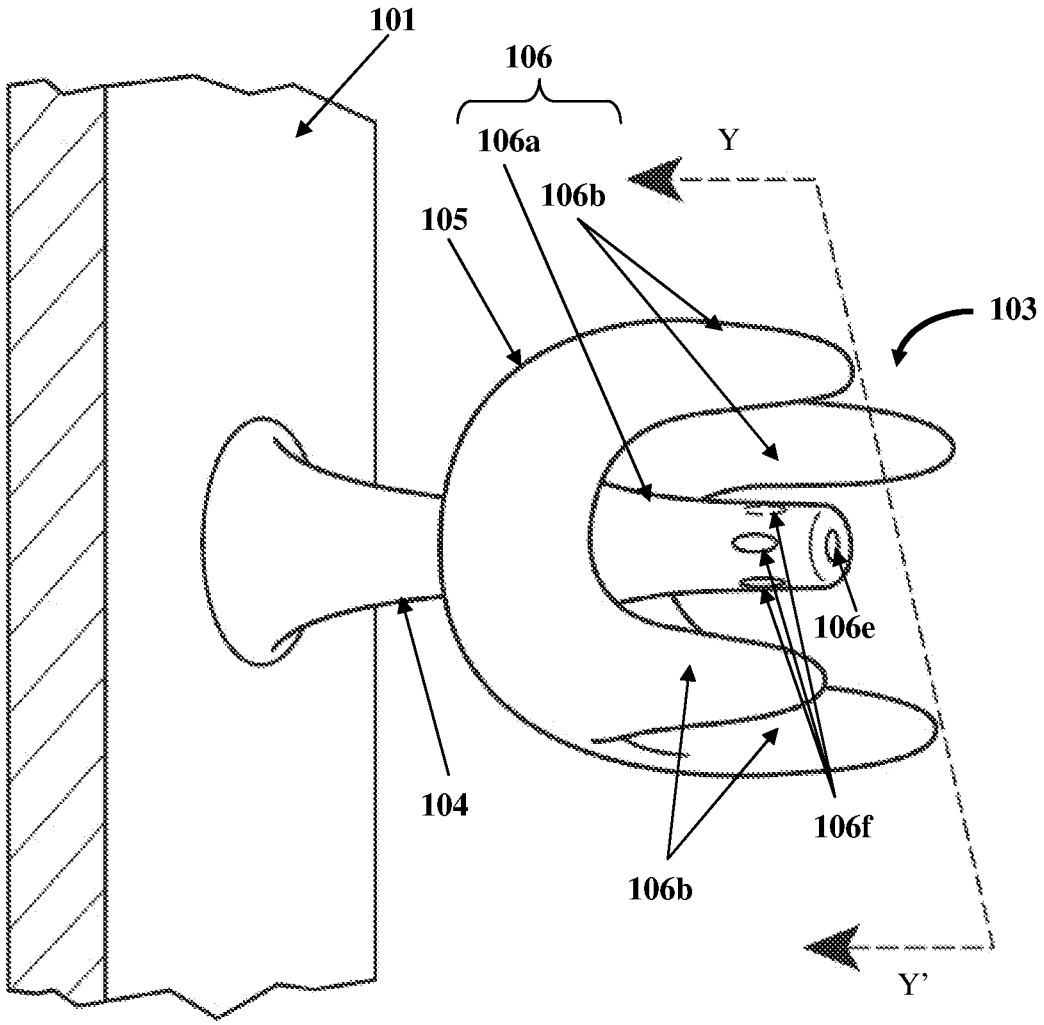
FIG. 10B exemplarily illustrates an enlarged isometric view of the embodiment of the cleansing member attached to the base member of the body cleansing apparatus, showing a section Y-Y' taken along the cleansing member.
Figure 10C:
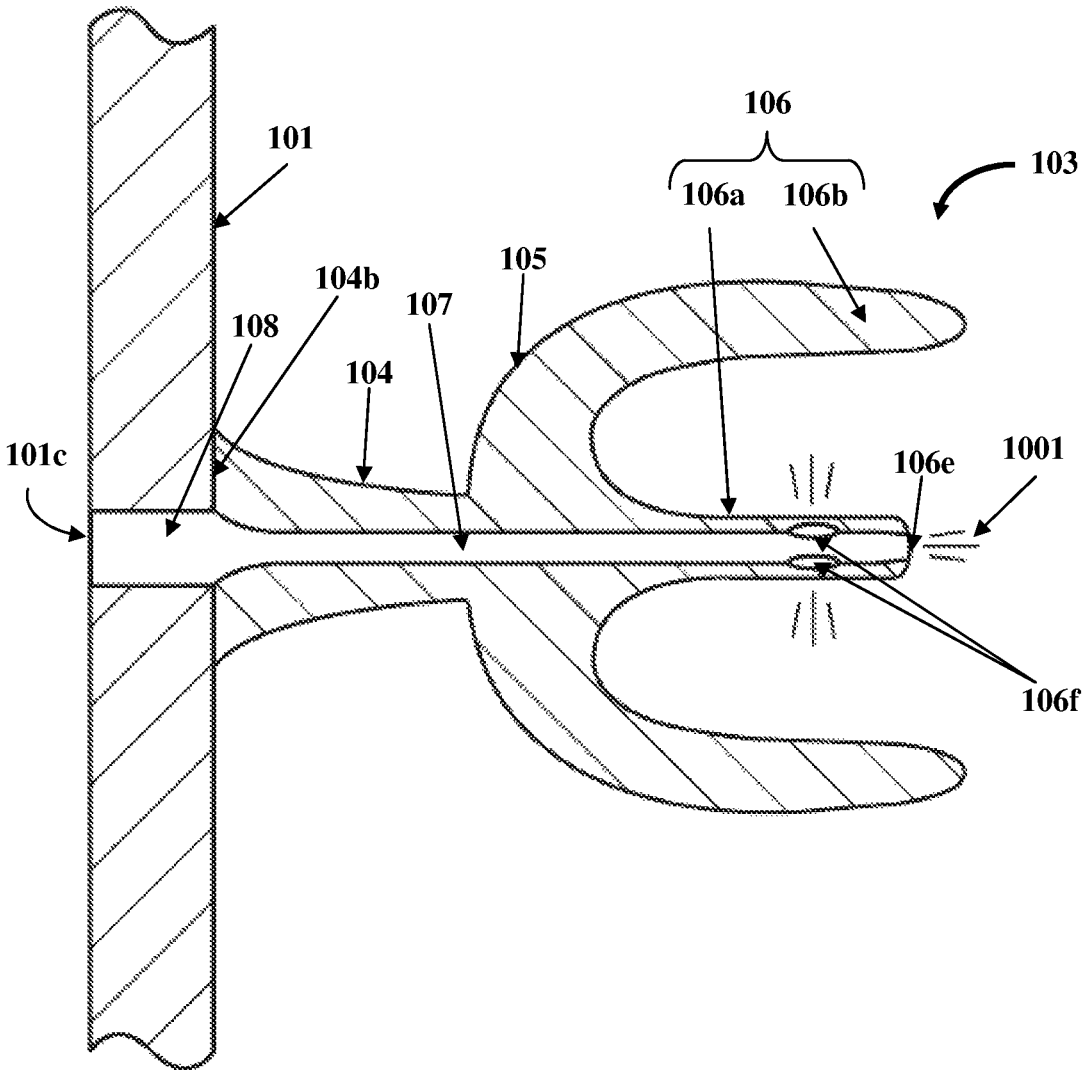
FIG. 10C exemplarily illustrates an enlarged sectional view of the embodiment of the cleansing member attached to the base member of the body cleansing apparatus, taken along the section Y-Y' of FIG. 10B, showing a cavity within the stem, in fluid communication with a bladder that contains a cleansing agent.

As exemplarily illustrated in FIG. 10A and FIG. 10C, a cylindrical bladder 108 that stores the cleansing agent 1001 extends from the lower end 104*b* of the stem 104 of the cleansing member 103 to the rear surface 101*c* of the base member 101. The stored cleansing agent 1001 is drawn from the bladder 108 through the stem 104 and out through one or more apertures 106*e* and 106*f* positioned on the body of the central flexible bristle 106*a*, when the user's body part contacts and applies a pressure on the stem 104, for dispensing the cleansing agent 1001. The stem 104 of the cleansing member 103 comprises a cavity 107, in fluid communication with the bladder 108 defined within the base member 101, for extracting the cleansing agent 1001 stored in the bladder 108, containing, and dispensing the cleansing agent 1001 through one or more apertures 106*e* and 106*f* positioned, for example, on the central flexible bristle 106*a* for cleansing the user's body part, when the user's body part contacts and applies pressure on the stem 104. As exemplarily illustrated in FIG. 10A, the cleansing agent 1001 is drawn from the bladder 108 through the cavity 107 and out through the aperture 106*e* on the tip 106*c* of the central flexible bristle 106*a*, when the user's body part contacts and applies a pressure on the stem 104.

In another embodiment, any two of the flexible bristles 106*b* can be joined together to create a web (not shown) for collecting the cleansing agent 1001, for example, soap particulates within the cluster 105 of flexible bristles 106.

FIG. 10B exemplarily illustrates an enlarged isometric view of the embodiment of the cleansing member 103 attached to the base member 101 of the body cleansing apparatus 100 exemplarily illustrated in FIG. 2, showing a section Y-Y' taken along the cleansing member 103.

FIG. 10C exemplarily illustrates an enlarged sectional view of the embodiment of the cleansing member 103 attached to the base member 101 of the body cleansing apparatus 100 exemplarily illustrated in FIG. 2, taken along the section Y-Y' of FIG. 10B, showing a cavity 107 within the stem 104, in fluid communication with a bladder 108 that contains a cleansing agent 1001. As exemplarily illustrated in FIG. 10C, the cleansing agent 1001 is drawn from the bladder 108 through the cavity 107 and out through the apertures 106*e* and 106*f* of the central flexible bristle 106*a*, when the user's body part contacts and applies a pressure on the stem 104.

Figure 11:
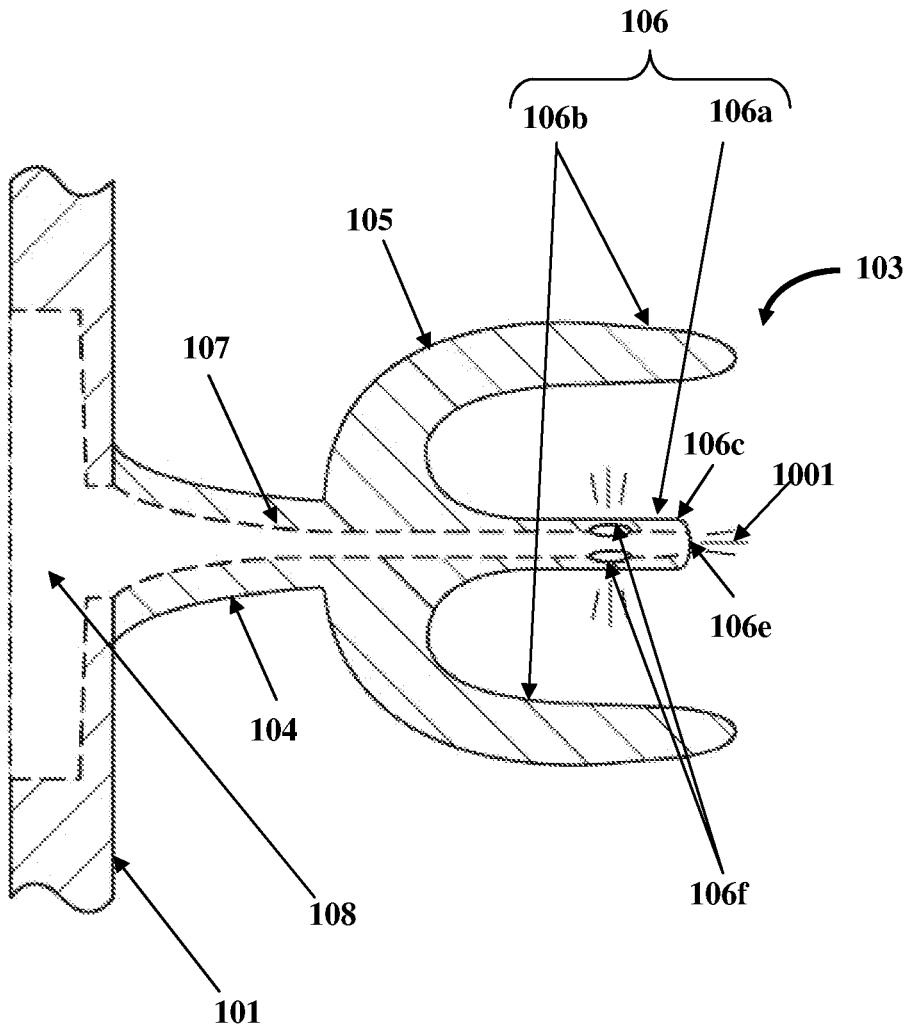
FIG. 11 exemplarily illustrates an enlarged sectional view of an embodiment of the cleansing member attached to the base member of the body cleansing apparatus, showing the cavity in the stem in fluid communication with an extended bladder defined in the base member.

FIG. 11 exemplarily illustrates an enlarged sectional view of an embodiment of the cleansing member 103 attached to the base member 101 of the body cleansing apparatus 100 exemplarily illustrated in FIG. 2, showing the cavity 107 in the stem 104 in fluid communication with an extended bladder 108 defined in the base member 101. In an embodiment, an extended bladder 108 is defined within the base member 101 for storing the cleansing agent 1001. As exemplarily illustrated in FIG. 11, the cavity 107 communicates with the extended bladder 108 defined within the base member 101, for extracting the cleansing agent 1001 stored in the extended bladder 108, containing, and dispensing the cleansing agent 1001 through the apertures 106*e* and 106*f* positioned on the body of the central flexible bristle 106*a* for cleansing the user's body part, when the user's body part contacts and applies pressure on the stem 104. The cleansing agent 1001 is dispensed from the cavity 107 towards the tips 106*c* and 106*d* of any of the flexible bristles 106 via their apertures 106*e* and 106*f* respectively, for cleansing the user's body part. For example, the cleansing agent 1001 such as liquid soap is dispensed through the tip 106*c* of the central flexible bristle 106*a* via its aperture 106*e*, when a user's body part, for example, the user's back applies pressure to the stem 104. In another embodiment, the cleansing agent 1001 is dispensed from the cavity 107 towards the tip 106*d* of any of the other flexible bristles 106*b*.

When the user's body part contacts and pushes against the central flexible bristle 106*a*, the cleansing agent 1001 is dispensed from the cavity 107 towards the tip 106*c* of the central flexible bristle 106*a* and then onto the user's body part that contacts the tip 106*c*. In an embodiment, any other flexible bristle 106*b* can comprise a cavity similar to the cavity 107 for containing and dispensing the cleansing agent 1001.

Figure 12A:
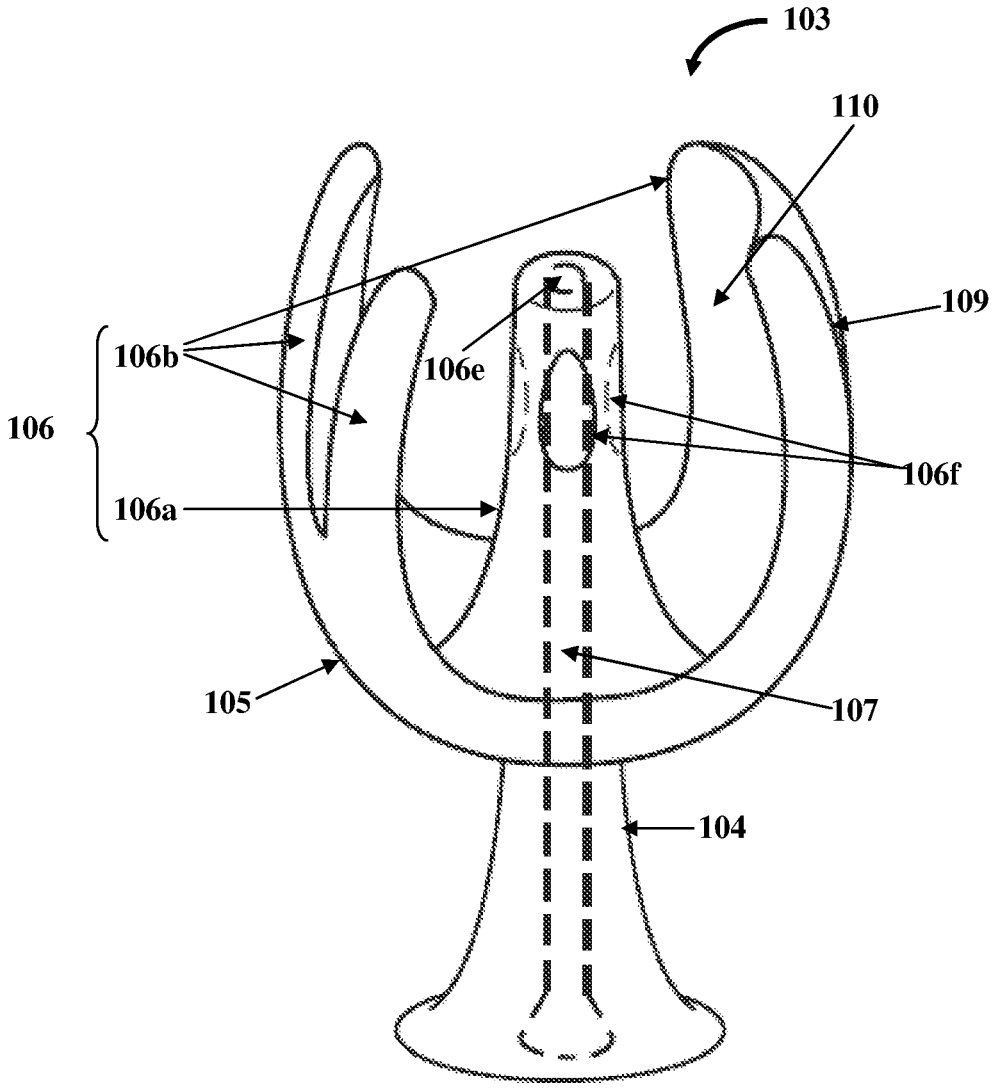
FIG. 12A exemplarily illustrates an isometric view of an embodiment of the cleansing member, showing a flexible bristle in the cluster in a wide generally concave configuration that defines a reservoir configured to collect and retain a cleansing agent for cleansing the user's body part.
Figure 12B:
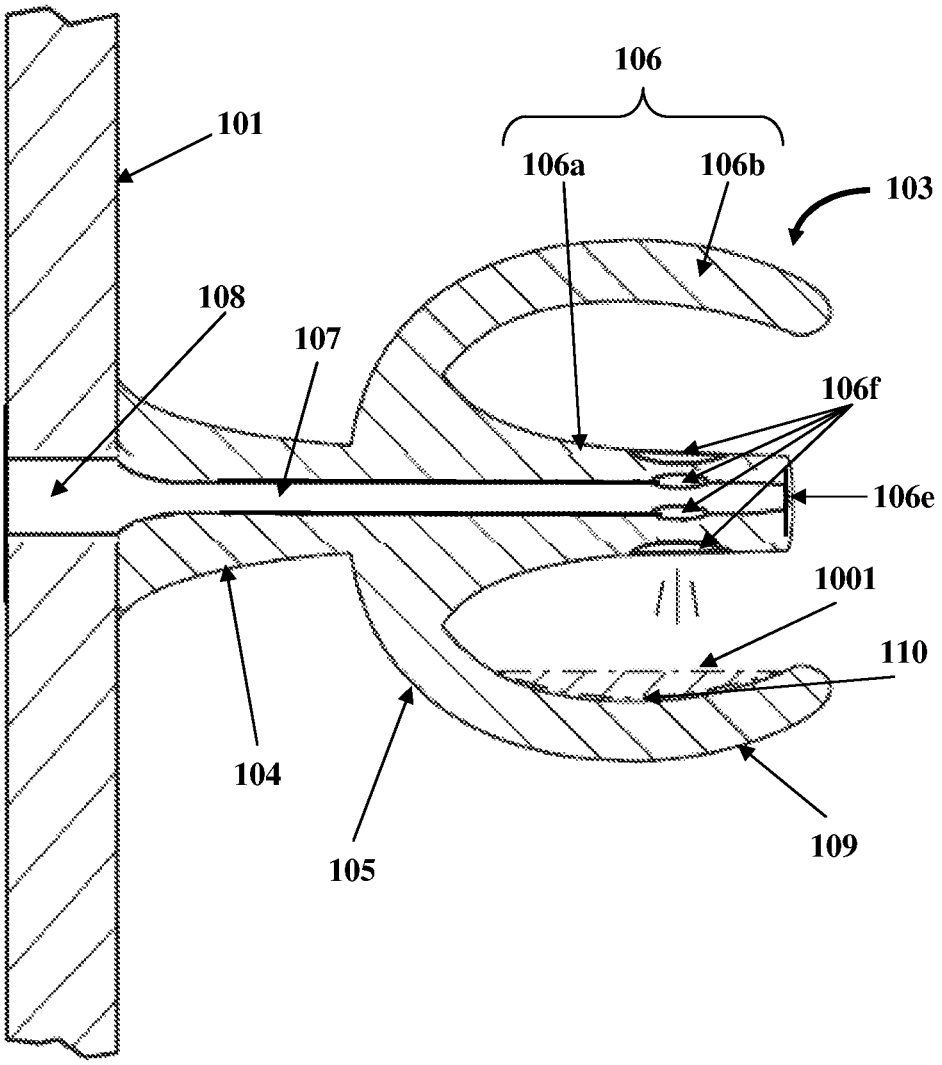
FIG. 12B exemplarily illustrates an enlarged sectional view of the embodiment of the cleansing member attached to the base member of the body cleansing apparatus, where the stem of the cleansing member comprises a cavity in fluid communication with the bladder defined in the base member, for dispensing the cleansing agent stored in the bladder into the reservoir defined by a flexible bristle in the cluster.

FIG. 12A exemplarily illustrates an isometric view of an embodiment of the cleansing member 103, showing a flexible bristle 109 in the cluster 105 of flexible bristles 106 in a wide generally concave configuration that defines a reservoir 110 configured to collect and retain a cleansing agent 1001 as exemplarily illustrated in FIG. 12B, for cleansing the user's body part. The reservoir 110 is configurable for receiving, storing, and retaining a cleansing agent 1001 as exemplarily illustrated in FIG. 12B, FIG. 13, and FIGS. 15-16, and releasing the cleansing agent 1001 along the flexible bristles 106 when the user's body part contacts and applies pressure on the stem 104.

FIG. 12B exemplarily illustrates an enlarged sectional view of the embodiment of the cleansing member 103 attached to the base member 101 of the body cleansing apparatus 100 exemplarily illustrated in FIG. 2, where the stem 104 of the cleansing member 103 comprises a cavity 107 in fluid communication with the bladder 108 defined in the base member 101, for dispensing a cleansing agent 1001, for example, soap stored in the bladder 108 into the reservoir 110 defined by a flexible bristle 109 in the cluster 105. When the body cleansing apparatus 100 is attached to a support structure 2801, for example, a wall as exemplarily illustrated in FIG. 28, the cleansing member 103 exemplarily illustrated in FIG. 12A attached to the base member 101 is oriented in a generally horizontal position as exemplarily illustrated in FIG. 12B. When the user's body part contacts and pushes against the central flexible bristle 106*a* of the cleansing member 103, the cleansing agent 1001 dispenses from the cavity 107 through the apertures 106*e* and 106*f* of the central flexible bristle 106*a* and collects in the reservoir 110 defined by the flexible bristle 109 which is in the wide generally concave configuration, thereby retaining the cleansing agent 1001 within the cluster 105 as exemplarily illustrated in FIG. 12B, for cleansing the user's body part. The cleansing agent 1001 coats the flexible bristles 106 and allows the application of the cleansing agent 1001 on the user's body part when the body part contacts and applies pressure on the flexible bristles 106.

Figure 13:
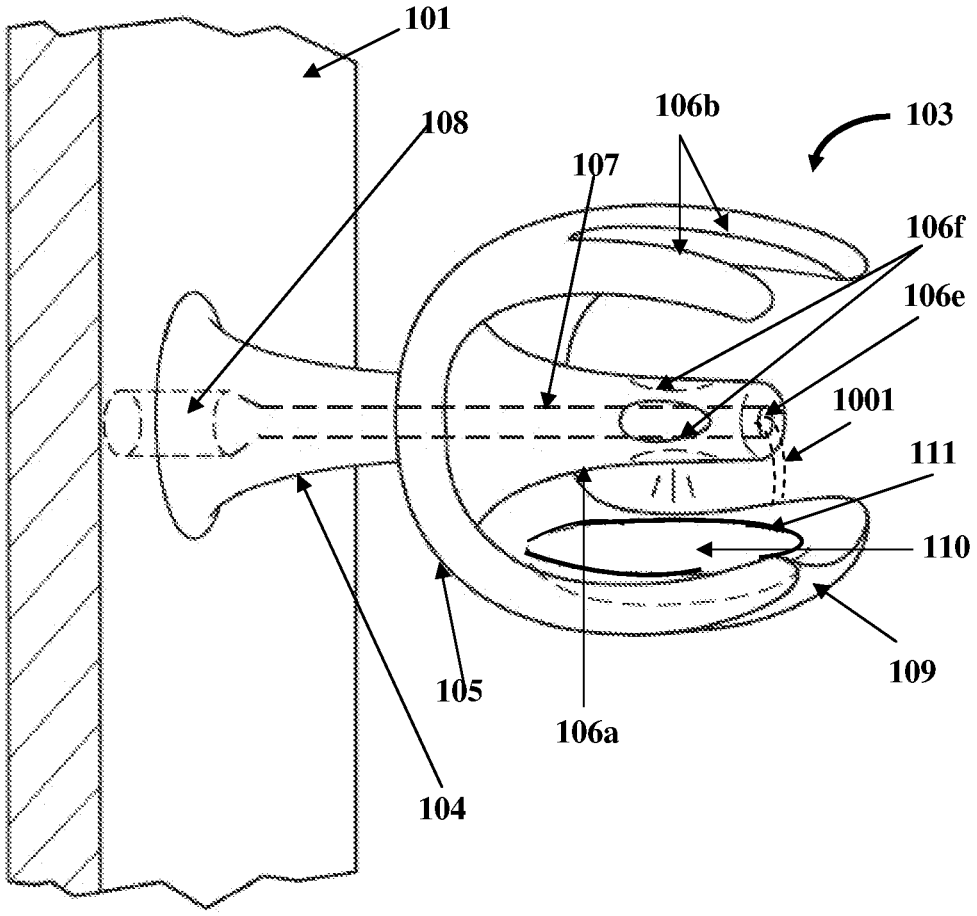
FIG. 13 exemplarily illustrates an enlarged isometric view of the embodiment of the cleansing member attached to the base member of the body cleansing apparatus, where one of the flexible bristles comprises a spoon section that defines a reservoir configured to collect and retain the cleansing agent dispensed from a cavity in the stem.

FIG. 13 exemplarily illustrates an enlarged isometric view of the embodiment of the cleansing member 103 attached to the base member 101 of the body cleansing apparatus 100 exemplarily illustrated in FIG. 2, where one of the flexible bristles 109 comprises a spoon section 111 that defines a reservoir 110 configured to collect and retain the cleansing agent 1001 dispensed from a cavity 107 in the stem 104. In this embodiment, a flexible bristle 109 that is in the wide generally concave configuration comprises the spoon section 111 that defines the reservoir 110. When the user's body part contacts and pushes against the central flexible bristle 106*a* of the cleansing member 103, the cleansing agent 1001 dispenses from the cavity 107 through the apertures 106*e* and 106*f* of the central flexible bristle 106*a* and collects in the reservoir 110 defined by the spoon section 111. The cleansing agent 1001, for example, soap settles in the spoon section 111, thereby retaining the cleansing agent 1001 within the cluster 105 as exemplarily illustrated in FIG. 13, for cleansing the user's body part.

Figure 14:
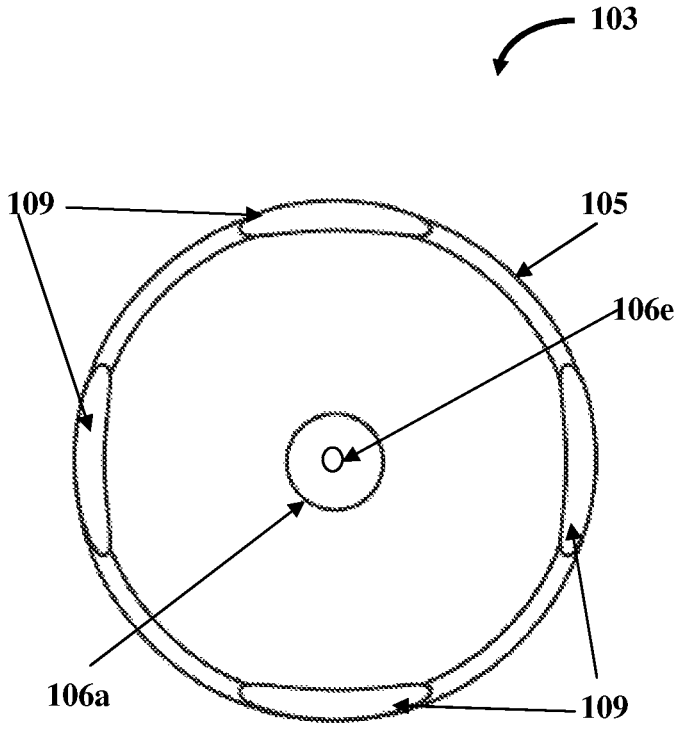
FIG. 14 exemplarily illustrates a top view of an embodiment of the cleansing member having wide generally concave shaped flexible bristles that collect and retain a cleansing agent.

FIG. 14 exemplarily illustrates a top view of an embodiment of the cleansing member 103 having wide generally concave shaped flexible bristles 109 that collect and retain a cleansing agent 1001 exemplarily illustrated in FIG. 12B and FIG. 13. In this embodiment, all the flexible bristles 109 in the clusters 105 have a wide generally concave configuration for collecting and retaining the cleansing agent 1001 within the cluster 105.

Figure 15:
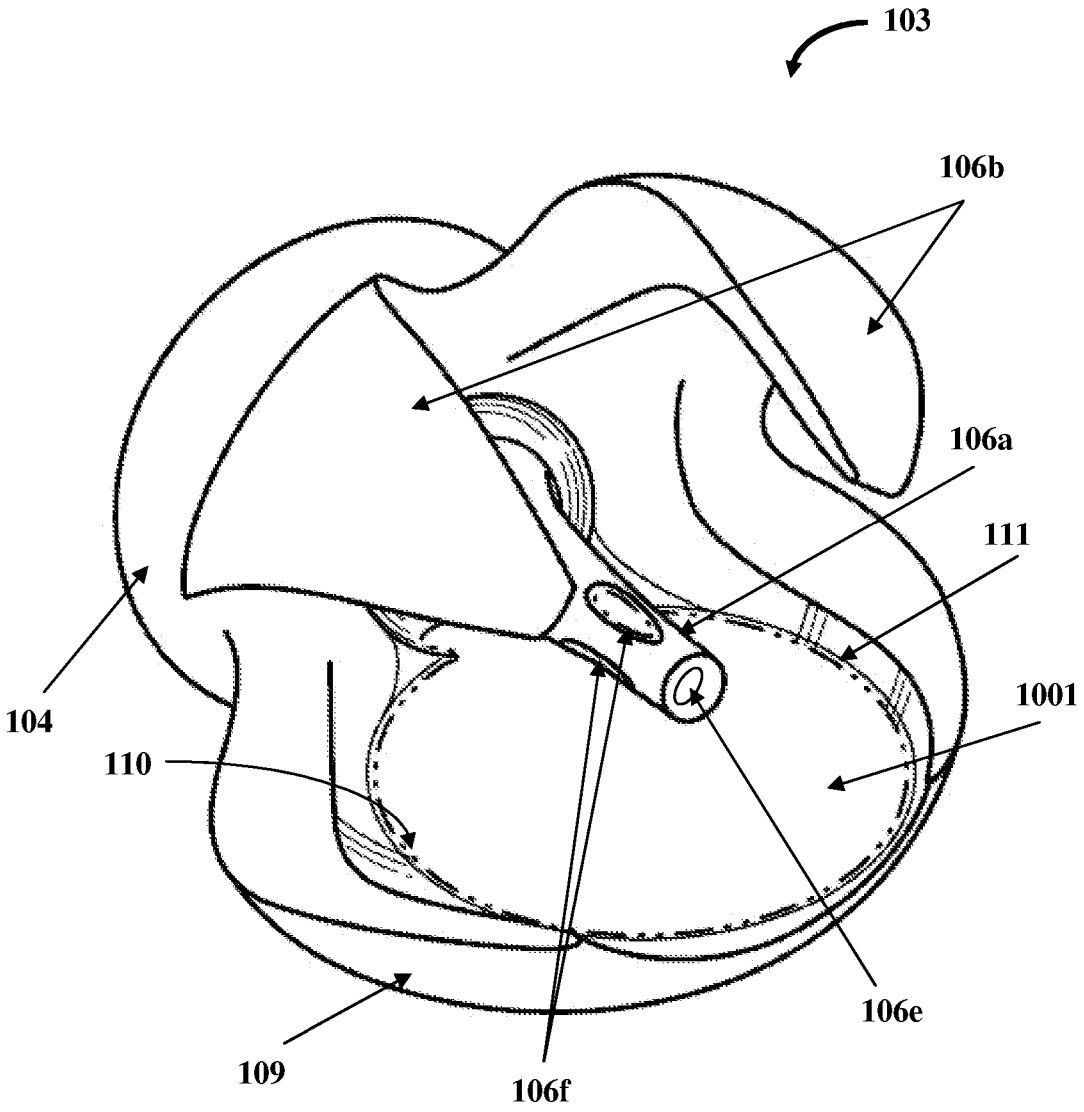
FIG. 15 exemplarily illustrates an isometric view of an embodiment of the cleansing member, where one of the flexible bristles comprises a wide spoon section that defines a reservoir configured to collect and retain the cleansing agent.

FIG. 15 exemplarily illustrates an isometric view of an embodiment of the cleansing member 103, where one of the flexible bristles 109 comprises a wide spoon section 111 that defines a reservoir 110 configured to collect and retain the cleansing agent 1001. The cleansing agent 1001 may, for example, be introduced into the wide spoon section 111 by the user or dispensed from a cavity 107 in the stem 104 through the apertures 106*e* and 106*f*, for example, in the central flexible bristle 106*a* and into the wide spoon section 111 for cleansing the user's body part.

Figure 16:
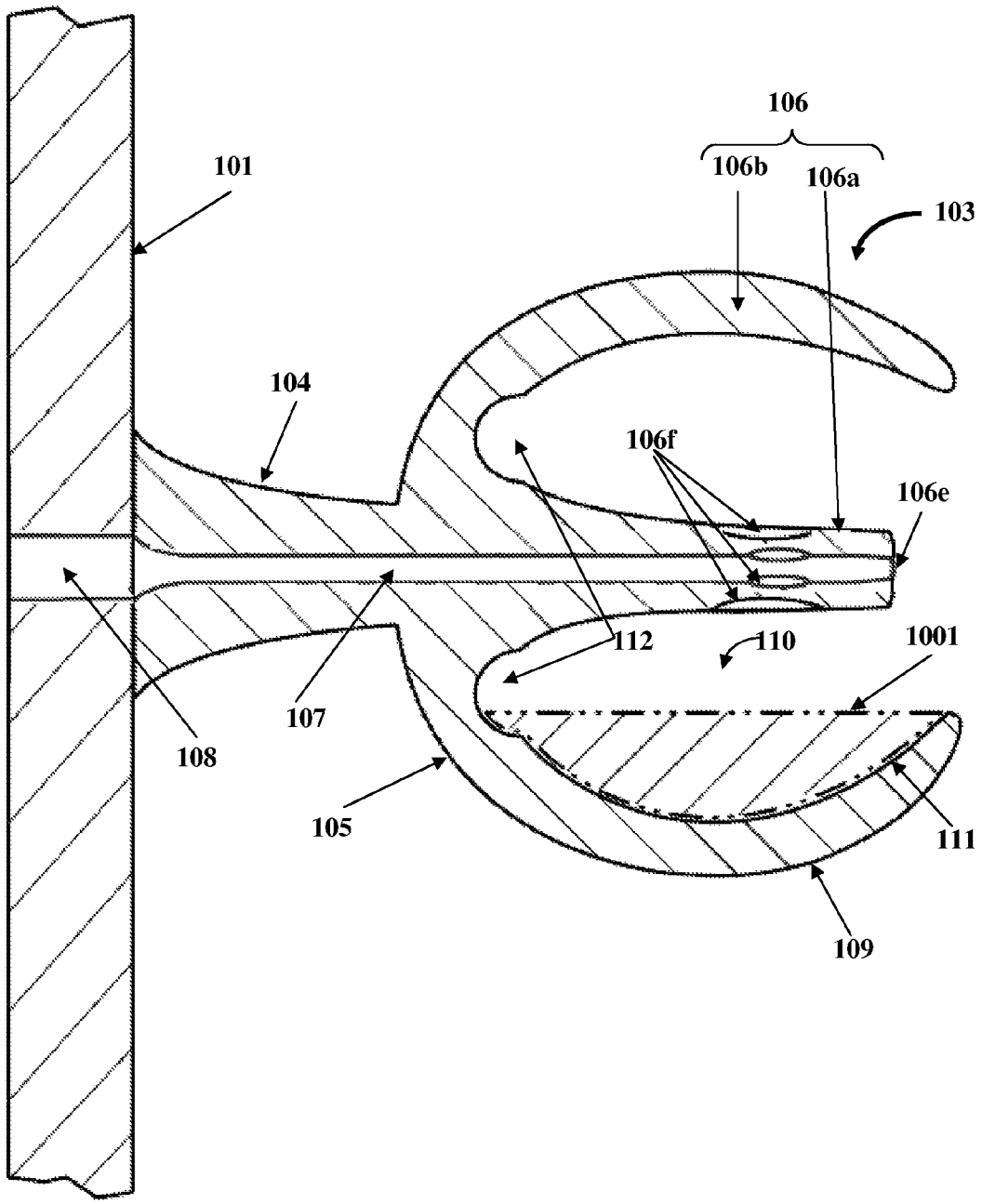
FIG. 16 exemplarily illustrates an enlarged sectional view of an embodiment of the cleansing member, where the flexible bristles comprise generally concave troughs positioned at a base of each of the flexible bristles.

FIG. 16 exemplarily illustrates an enlarged sectional view of an embodiment of the cleansing member 103, where the flexible bristles 106 and 109 comprise generally concave troughs 112 positioned at a base of each of the flexible bristles 106 and 109. The generally concave troughs 112 are positioned at the base of each of the flexible bristles 106 and 109 in the cluster 105 where each of the flexible bristles 106 and 109 meets the stem 104 of the cleansing member 103. The generally concave troughs 112 are circular, channel shaped around the central flexible bristle 106*a*. The generally concave troughs 112 are configured to contain the cleansing agent 1001. The cleansing agent 1001 is dispensed from the generally concave troughs 112 on application of pressure on the flexible bristles 106 and 109 by the user's body part, for example, the user's back. FIG. 16 also shows the spoon section 111 in the flexible bristle 109 having a wide generally concave configuration that defines the reservoir 110 for collecting and retaining the cleansing agent 1001. As exemplarily illustrated in FIG. 16, the generally concave trough 112 provided at the base of the flexible bristle 109 is in communication with the concave spoon section 111 of the flexible bristle 109 to contain the cleansing agent 1001. The spoon section 111 in the flexible bristle 109 having a wide generally concave configuration and the generally concave troughs 112 prevent the cleansing agent 1001 from draining out when the cleansing apparatus 100, exemplarily illustrated in FIG. 2, is attached in the vertical position against a support structure 2801 such as a wall as exemplarily illustrated in FIG. 28. The cleansing agent 1001 is dispensed from the generally concave trough 112 at the base of the flexible bristle 109 and also from the concave spoon section 111 of the flexible bristle 109 on application of pressure on the flexible bristles 106 and 109 by the user's back.

Figure 17:
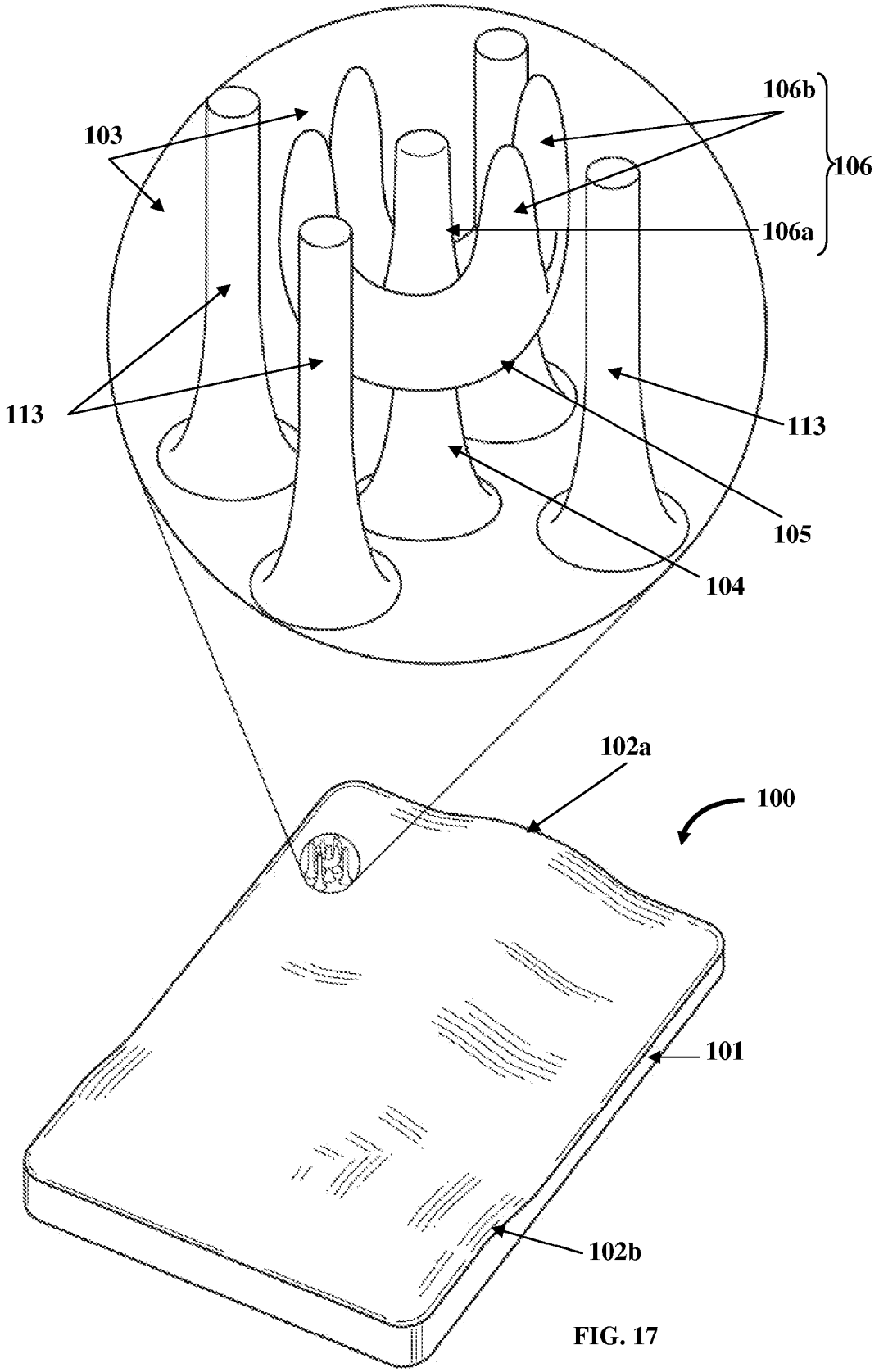
FIG. 17 exemplarily illustrates a front isometric view of the body cleansing apparatus, showing a projected enlarged view of a combination of two types of cleansing members positioned on the base member of the body cleansing apparatus.

FIG. 17 exemplarily illustrates a front isometric view of the body cleansing apparatus 100, showing a projected enlarged view of a combination of two types of cleansing members 103 positioned on the base member 101 of the body cleansing apparatus 100. In an embodiment, in addition to the cleansing members 103 having stems 104 and clusters 105 of flexible bristles 106, the body cleansing apparatus 100 also comprises single elongated flexible bristles 113. The single elongated flexible bristles 113 are attached to and extend outwardly from the base member 101. As exemplarily illustrated in FIG. 17, the single elongated flexible bristles 113 along with the clusters 105 of flexible bristles 106 are positioned and attached at multiple locations on the contoured profiles 102*a* and 102*b* of the base member 101. The flexible bristles 106 and 113 are flexible and slightly firm and are made of, for example, rubber.

For purposes of illustration, the detailed description refers to two types of cleansing members 103 positioned on the base member 101 of the body cleansing apparatus 100 as exemplarily illustrated in FIG. 17; however the scope of the body cleansing apparatus 100 disclosed herein is not limited to a combination of only these two types of cleansing members 103 but may be extended to include a combination of any of the cleansing members 103 exemplarily illustrated in FIG. 7, FIG. 10A, FIG. 11, FIG. 12A, FIGS. 13-16, and FIG. 18, and other cleansing members of different shapes and sizes.

Figure 18:
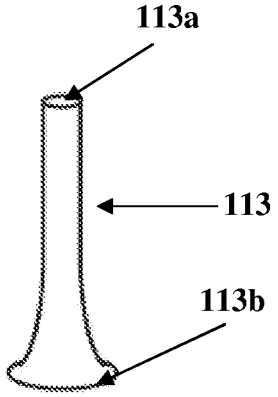
FIG. 18 exemplarily illustrates an isometric view of an embodiment of the cleansing member.
Figure 19:
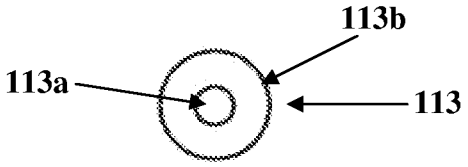
FIG. 19 exemplarily illustrates a top view of the embodiment of the cleansing member.
Figure 20:
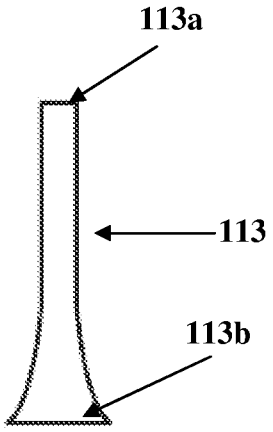
FIG. 20 exemplarily illustrates a side elevation view of the embodiment of the cleansing member.
Figure 21:
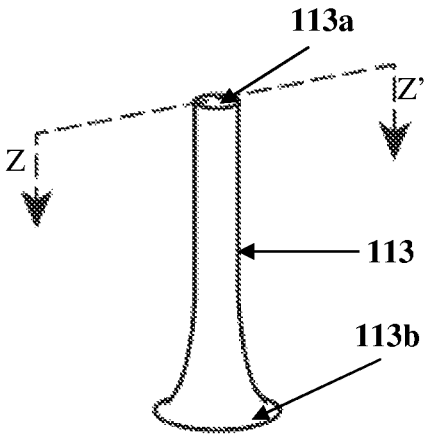
FIG. 21 exemplarily illustrates an isometric view of the embodiment of the cleansing member, showing a section Z-Z' taken along the cleansing member.
Figure 22:
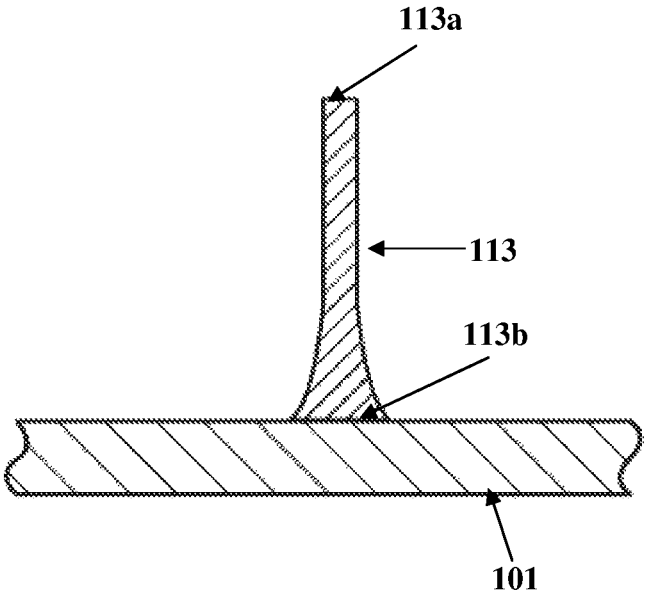
FIG. 22 exemplarily illustrates a sectional view of the embodiment of the cleansing member attached to the base member, taken along section Z-Z' of FIG. 21.

FIGS. 18-22 exemplarily illustrate different views of an embodiment of the cleansing member 103. In this embodiment, the cleansing member 103 is a single elongated flexible bristle 113 with a flat rounded upper end or tip 113*a* and a generally circular lower end 113*b*. FIG. 18 exemplarily illustrates an isometric view of this embodiment of the cleansing member 103. FIG. 19 exemplarily illustrates a top view of this embodiment of the cleansing member 103. FIG. 20 exemplarily illustrates a side elevation view of this embodiment of the cleansing member 103. FIG. 21 exemplarily illustrates an isometric view of this embodiment of the cleansing member 103, showing a section Z-Z' taken along the cleansing member 103. FIG. 22 exemplarily illustrates a sectional view of the embodiment of the cleansing member 103 attached to the base member 101, taken along section Z-Z' of FIG. 21. The single elongated flexible bristle 113 is attached to and extends outwardly from the base member 101.

Figure 23:
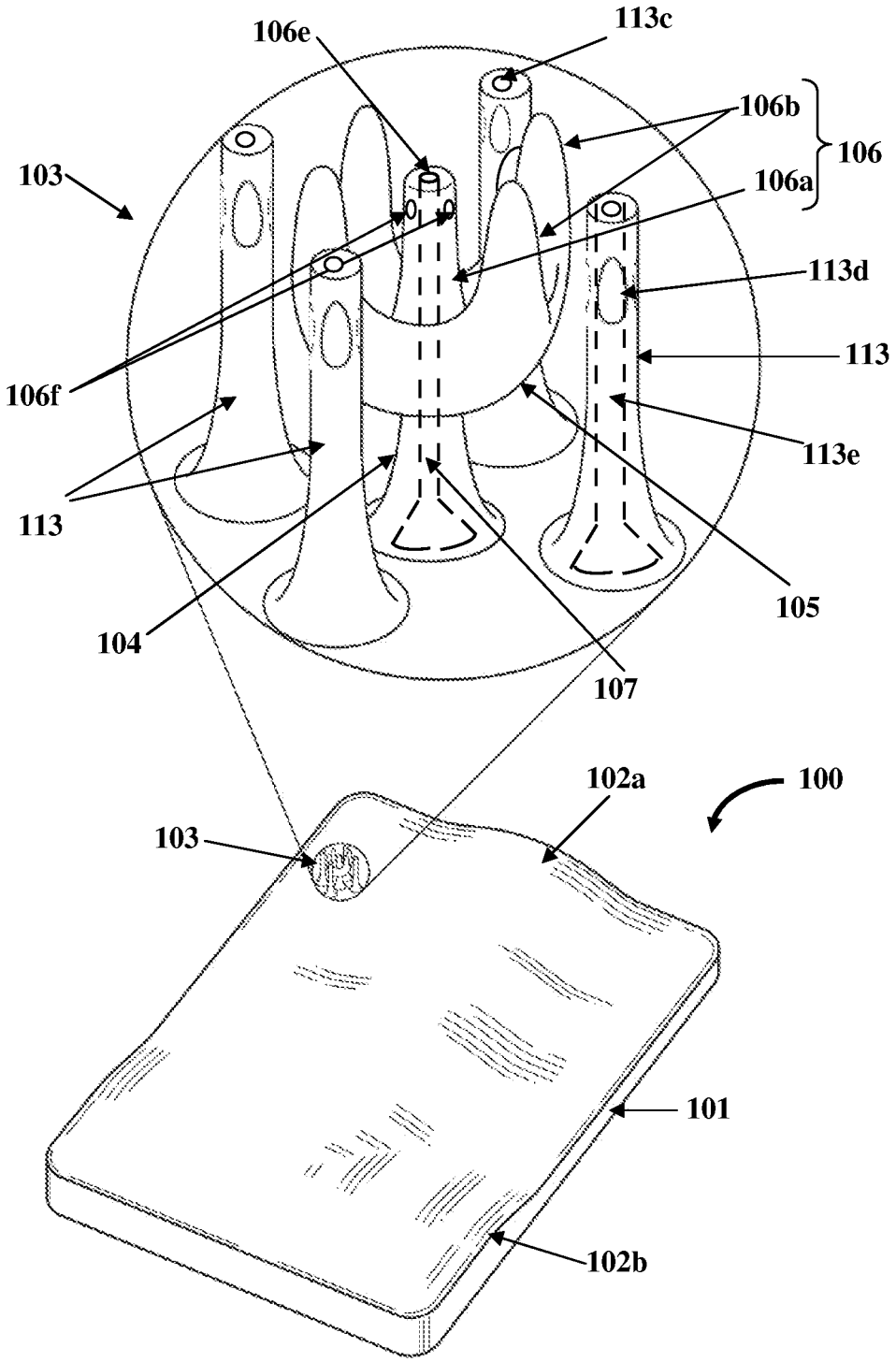
FIG. 23 exemplarily illustrates a front isometric view of the body cleansing apparatus, showing a projected enlarged view of a combination of two types of cleansing members positioned on the base member of the body cleansing apparatus, where each of the cleansing members comprises apertures for dispensing the cleansing agent.

FIG. 23 exemplarily illustrates a front isometric view of the body cleansing apparatus 100, showing a projected enlarged view of a combination of two types of cleansing members 103 positioned on the base member 101 of the body cleansing apparatus 100, where each of the cleansing members 103 comprises apertures 106*e*, 106*f* and 113*c* and 113*d* for dispensing the cleansing agent 1001 exemplarily illustrated in FIG. 10A, FIG. 10C, FIG. 11, and FIG. 13. For example, the cleansing agent 1001 is dispensed from the cavity 107 of the central flexible bristle 106*a* in the cluster 105 and out through the apertures 106*e* and 106*f* of the central flexible bristles 106*a* as disclosed in the detailed description of FIG. 10A and FIG. 11. In an embodiment, the elongated flexible bristle 113 also comprises a cavity 113*e*, in fluid communication with the bladder 108 defined within the base member 101 exemplarily illustrated in FIG. 10A, FIG. 10C, and FIG. 11, for extracting the cleansing agent 1001 stored in the bladder 108, containing, and dispensing the cleansing agent 1001 through one or more apertures 113*c* and 113*d* positioned, for example, on the body of the elongated flexible bristle 113 for cleansing the user's body part, when the user's body part contacts and applies pressure on the elongated flexible bristle 113.

Figure 24A:
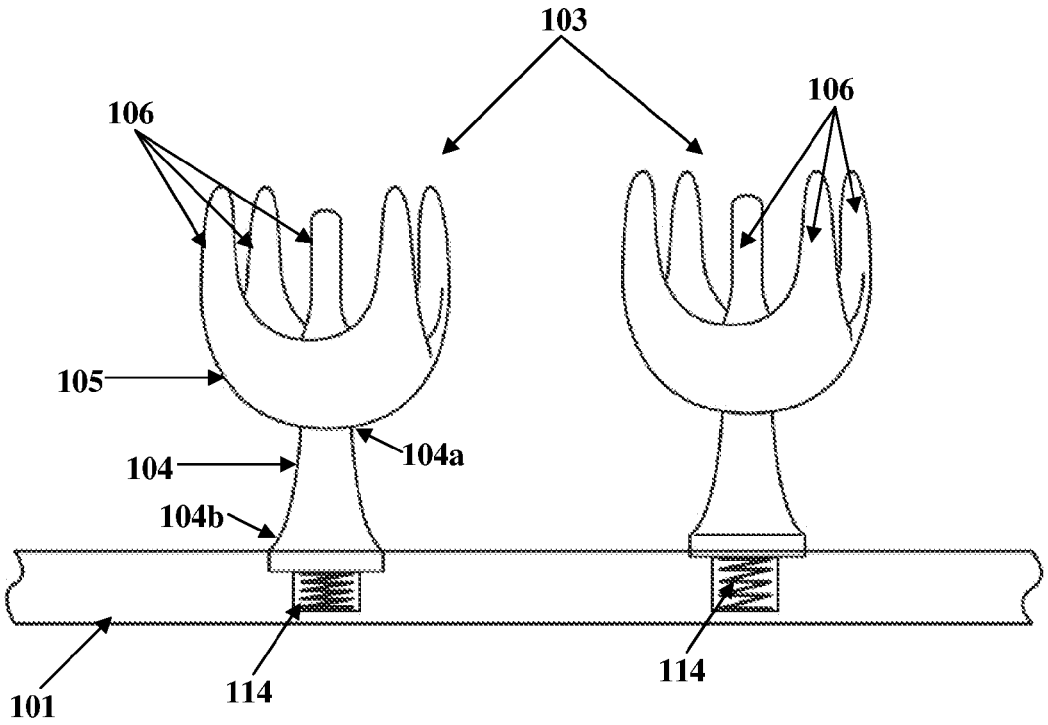
FIGS. 24A-24B exemplarily illustrate an embodiment of the body cleansing apparatus, showing a spring member operably connected to a lower end of each of the cleansing members.
Figure 24B:
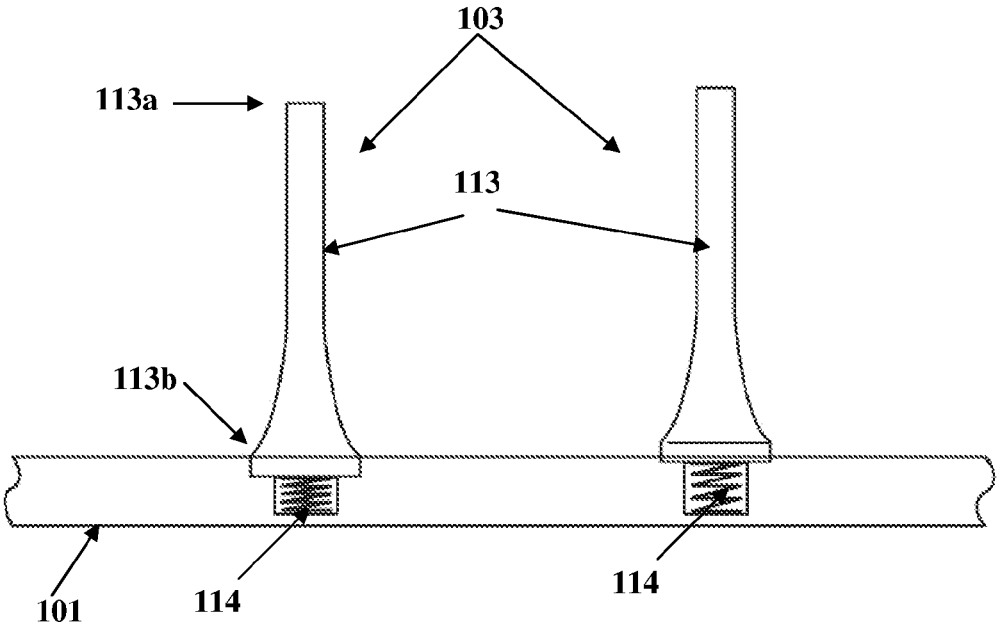

FIGS. 24A-24B exemplarily illustrate an embodiment of the body cleansing apparatus 100 exemplarily illustrated in FIG. 2, showing a spring member 114 operably connected to a lower end 104*b* or 113*b* of each of the cleansing members 103. As exemplarily illustrated in FIG. 24A, the spring member 114 is operably connected to a lower end 104*b* of the stem 104 of each of the cleansing members 103. As exemplarily illustrated in FIG. 24B, the spring member 114 is operably connected to a lower end 113*b* of each of the single elongated flexible bristles 113. The spring member 114 enables flexible movement of each of the cleansing members 103 during cleansing of the user's body part.

Figure 25:
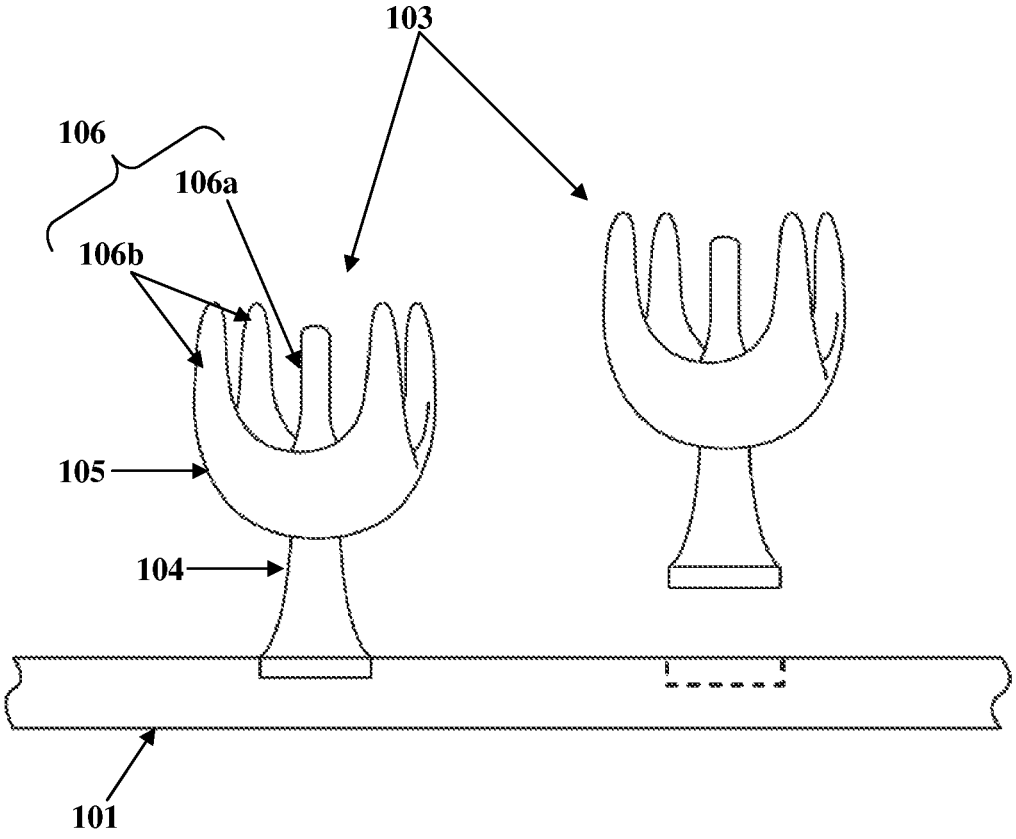
FIG. 25 exemplarily illustrates an embodiment of the body cleansing apparatus, showing a cleansing member detachably attachable to the base member.

FIG. 25 exemplarily illustrates an embodiment of the body cleansing apparatus 100 exemplarily illustrated in FIG. 2, showing a cleansing member 103 detachably attachable to the base member 101. In an embodiment, one or more of the cleansing members 103 are detachably attachable to one or more of multiple locations on one or more contoured profiles 102*a* and 102*b* of the base member 101 exemplarily illustrated in FIGS. 1-2 and FIGS. 4-6, for allowing the user to flexibly configure the cleansing members 103 on the base member 101 for the cleansing of the user's body part. For example, the user may attach multiple cleansing members 103 on the central contoured profile 102*a* to particularly clean the posterior curvature of the user's back. A user may detach one or more of the cleansing members 103 and attach them to another contoured profile 102*a* or 102*b* of the base member 101, for example, using glue, suction cups, etc.

Figure 26:
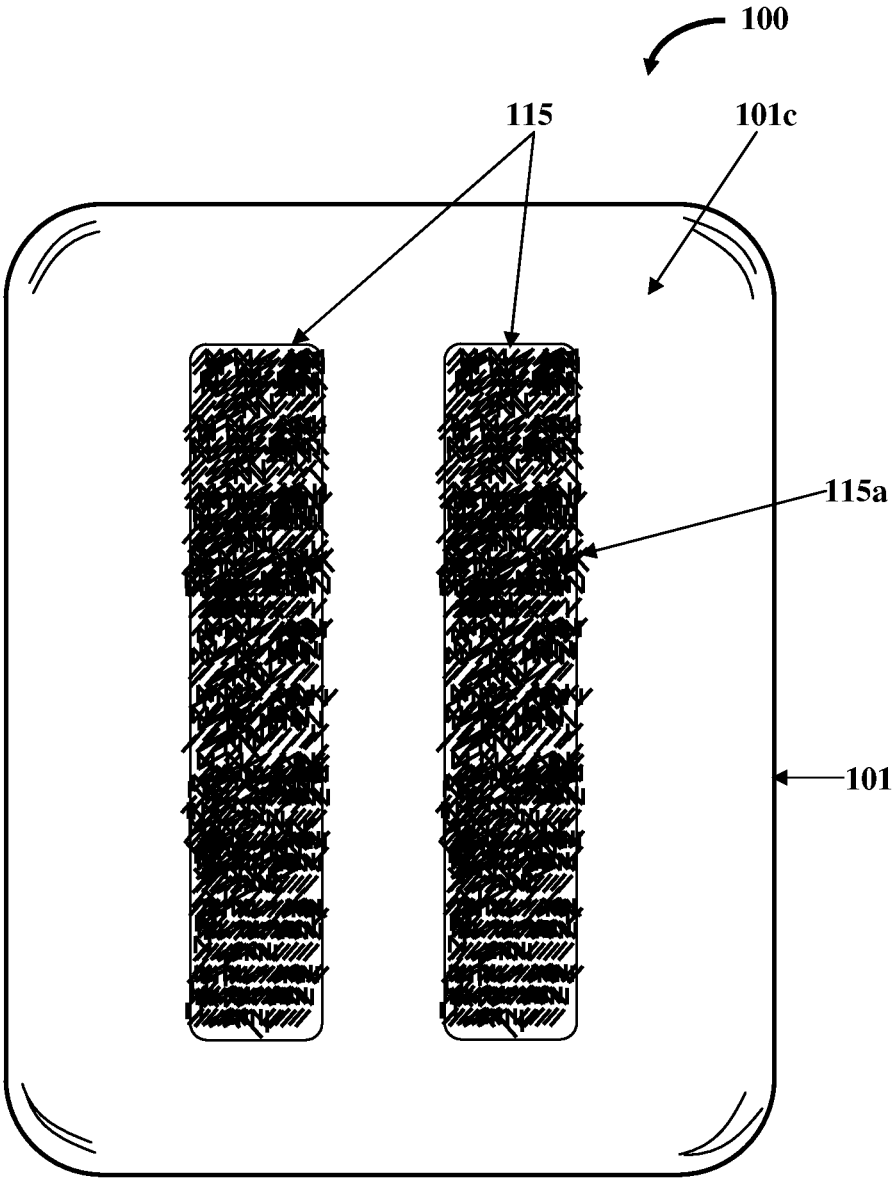
FIG. 26 exemplarily illustrates a rear elevation view of the body cleansing apparatus, showing fasteners attached to a rear surface of the base member for detachably attaching the body cleansing apparatus to a support structure.
Figure 27:
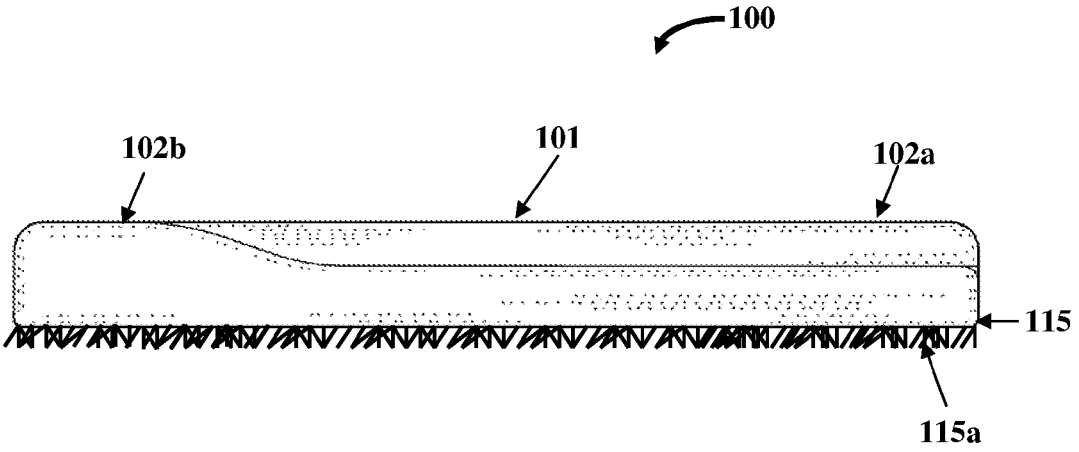
FIG. 27 exemplarily illustrates a right side elevation view of the body cleansing apparatus, showing fasteners attached to a rear surface of the base member for detachably attaching the body cleansing apparatus to a support structure.
Figure 28:
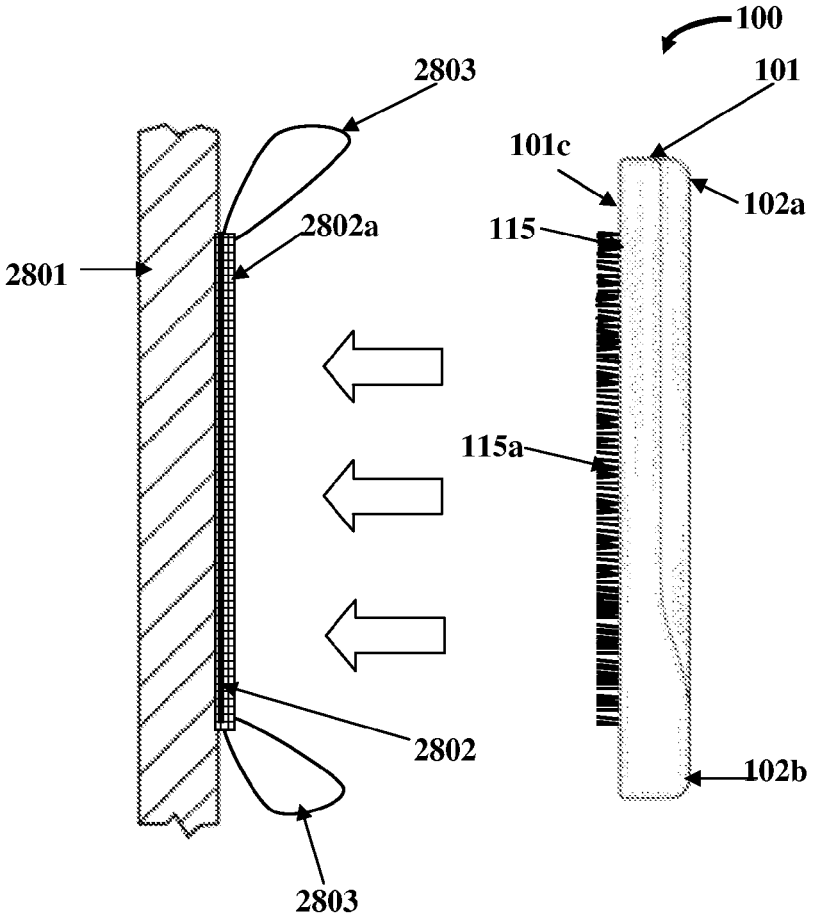
FIG. 28 exemplarily illustrates attachment of the body cleansing apparatus to a support structure using fasteners.

FIGS. 26-27 exemplarily illustrate a rear elevation view and a right side elevation view respectively, of the body cleansing apparatus 100, showing fasteners 115*a* attached to a rear surface 101*c* of the base member 101 for detachably attaching the body cleansing apparatus 100 to a support structure 2801 exemplarily illustrated in FIG. 28. In an example, strips 115 of hook sides or loop sides 115*a* of hook and loop fasteners 115*a* and 2802*a* such as Velcro® of Velcro Industries are used for detachably attaching the rear surface 101*c* of the base member 101 of the body cleansing apparatus 100 to a support structure 2801, for example, a wall of a bathroom. The hook and loop fasteners 115*a* and 2802*a* comprise hook sides 2802*a* and loop sides 115*a*. The hook sides 2802*a* or the loop sides 115*a* of the hook and loop fasteners 115*a* and 2802*a* are affixed on the rear surface 101*c* of the base member 101, while an opposing one of the hook sides 2802*a* or the loop sides 115*a* of the hook and loop fasteners 115*a* and 2802*a* are attached to the support structure 2801 for allowing the detachable attachment of the body cleansing apparatus 100 to the support structure 2801. For example, if the loop sides 115*a* of the hook and loop fasteners 115*a* and 2802*a* are affixed on the rear surface 101*c* of the base member 101 as exemplarily illustrated in FIGS. 26-28, the hook sides 2802*a* of the hook and loop fasteners 115*a* and 2802*a* are attached to the support structure 2801 and vice versa as exemplarily illustrated in FIG. 28. The hook sides 2802*a* or the loop sides 115*a* of the hook and loop fasteners 115*a* and 2802*a* are affixed on the rear surface 101*c* of the base member 101, for example, by sewing, using adhesives, etc.

FIG. 28 exemplarily illustrates attachment of the body cleansing apparatus 100 to a support structure 2801 using fasteners 115*a* and 2802*a*. As exemplarily illustrated in FIG. 28, a strip 2802 of the hook sides 2802*a* of the hook and loop fasteners 115*a* and 2802*a* are attached to the support structure 2801, for example, a wall. The corresponding loop sides 115*a* of the hook and loop fasteners 115*a* and 2802*a* are attached to the rear surface 101*c* of the base member 101 of the body cleansing apparatus 100. A user may apply pressure and push the rear surface 101*c* of the base member 101 having the loop sides 115*a* of the hook and loop fasteners 115*a* and 2802*a* against the hook sides 2802*a* of the hook and loop fasteners 115*a* and 2802*a* on the support structure 2801 to attach the body cleansing apparatus 100 to the support structure 2801. The strip 2802 on the support structure 2801 further comprises opposing loops 2803 to allow a user to grasp the loops 2803 and detach the body cleansing apparatus 100 from the support structure 2801.

In an embodiment, fasteners, for example, vacuum chucks, suction cups, etc., may also be used for detachably attaching the body cleansing apparatus 100 to the support structure 2801. The fasteners, for example, suction cups, on the rear surface 101*c* of the base member 101 of the body cleansing apparatus 100 engage the support structure 2801 and create suction between the suction cups and the support structure 2801 to mount the body cleansing apparatus 100 to the support structure 2801. In an example, four suction cups positioned proximal to the four corners of the base member 101 detachably attach the base member 101 of the body cleansing apparatus 100 to a bathroom wall. The vacuum suction cups hold the body cleansing apparatus 100 rigidly against the wall of the bathroom.

Figure 29:
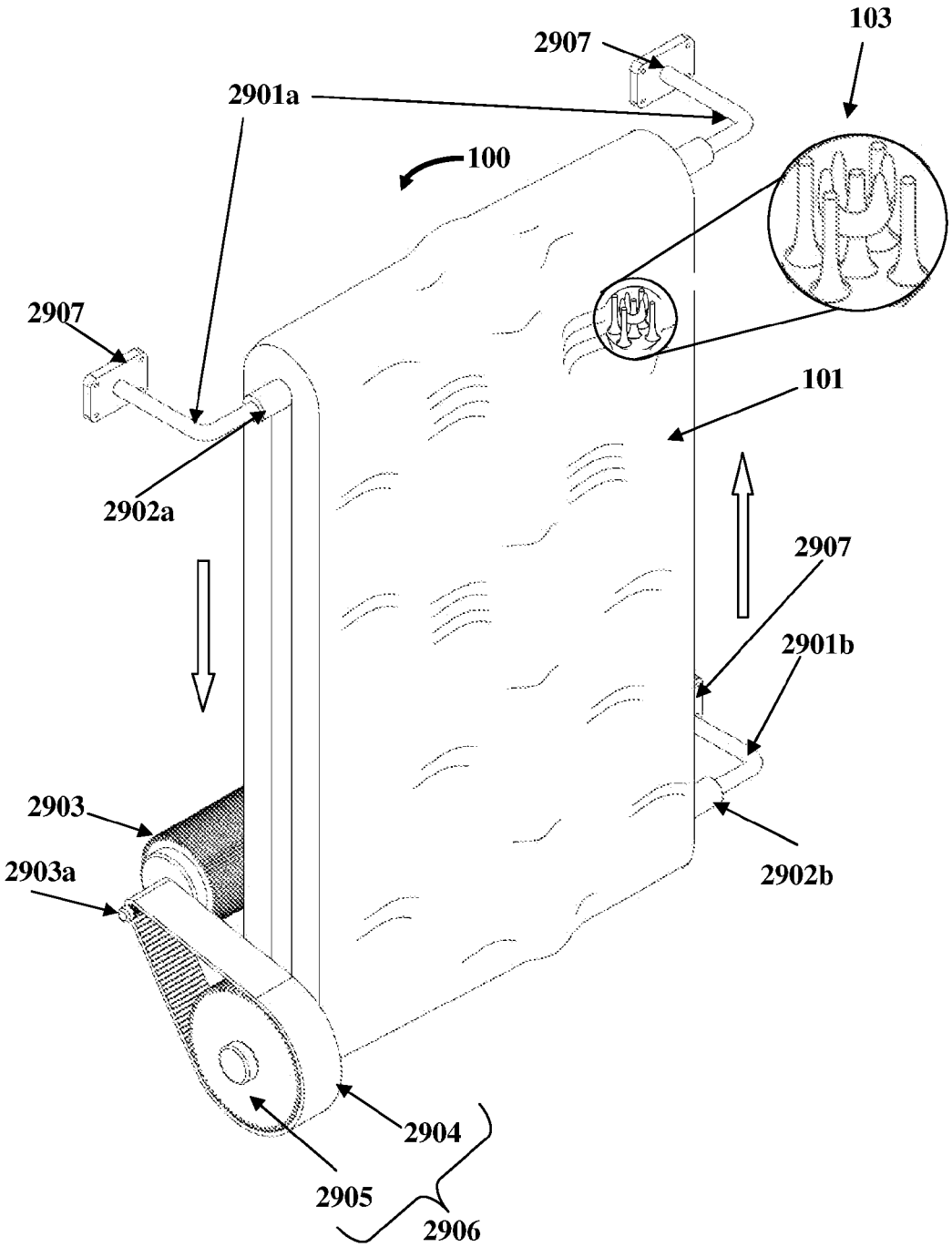
FIG. 29 exemplarily illustrates an embodiment of the body cleansing apparatus, showing the body cleansing apparatus rollably wrapped around spaced apart elongate rods.

FIG. 29 exemplarily illustrates an embodiment of the body cleansing apparatus 100, showing the body cleansing apparatus 100 rollably wrapped around spaced apart elongate rods 2901*a* and 2901*b*. In an embodiment, the elongate rods 2901*a* and 2901*b* are spaced apart and horizontally attached to a support structure 2801, for example, a wall as exemplarily illustrated in FIG. 28, using fasteners 2907. In this embodiment, elongate rollers 2902*a* and 2902*b* are coaxially disposed around the elongate rods 2901*a* and 2901*b* respectively. The body cleansing apparatus 100 is configured to slidably roll over the elongate rollers 2902*a* and 2902*b*. A motor 2903 and a belt driven wheel assembly 2906 are also provided in this embodiment. The belt driven wheel assembly 2906 is operably connected to one of the elongate rollers 2902*a* and 2902*b*, for example, the lower elongate roller 2902*b* for rolling the body cleansing apparatus 100 over the elongate rollers 2902*a* and 2902*b* and enhancing the cleansing of the user's body part. The belt driven wheel assembly 2906 comprises a reduction gear wheel 2905 and a belt drive 2904. A shaft 2903*a* of the motor 2903 is operably connected to the belt drive 2904 that is disposed around the reduction gear wheel 2905. The reduction gear wheel 2905 is operably connected to one of the elongate rollers 2902*a* and 2902*b*, for example, the lower elongate roller 2902*b*. When the motor 2903 is powered, the shaft 2903*a* of the motor 2903 rotates and transmits a torque to the reduction gear wheel 2905 through the belt drive 2904. The reduction gear wheel 2905 transmits the torque to the lower elongate roller 2902*b*, which rolls and causes the body cleansing apparatus 100 to slidably roll over the elongate rollers 2902*a* and 2902*b*. In an embodiment, a control unit (not shown) operably connected to the motor 2903 and the belt driven wheel assembly 2906 may be used to control and change the direction of rolling of the body cleansing apparatus 100 to create a timed upward and downward rolling motion of the body cleansing apparatus 100. The upward and downward rolling motion of the body cleansing apparatus 100 allows the user to stand still and clean his/her back without any effort. A switch (not shown) is provided to operate the motor 2903 to produce the driving torque that rolls the body cleansing apparatus 100.

Figure 30:
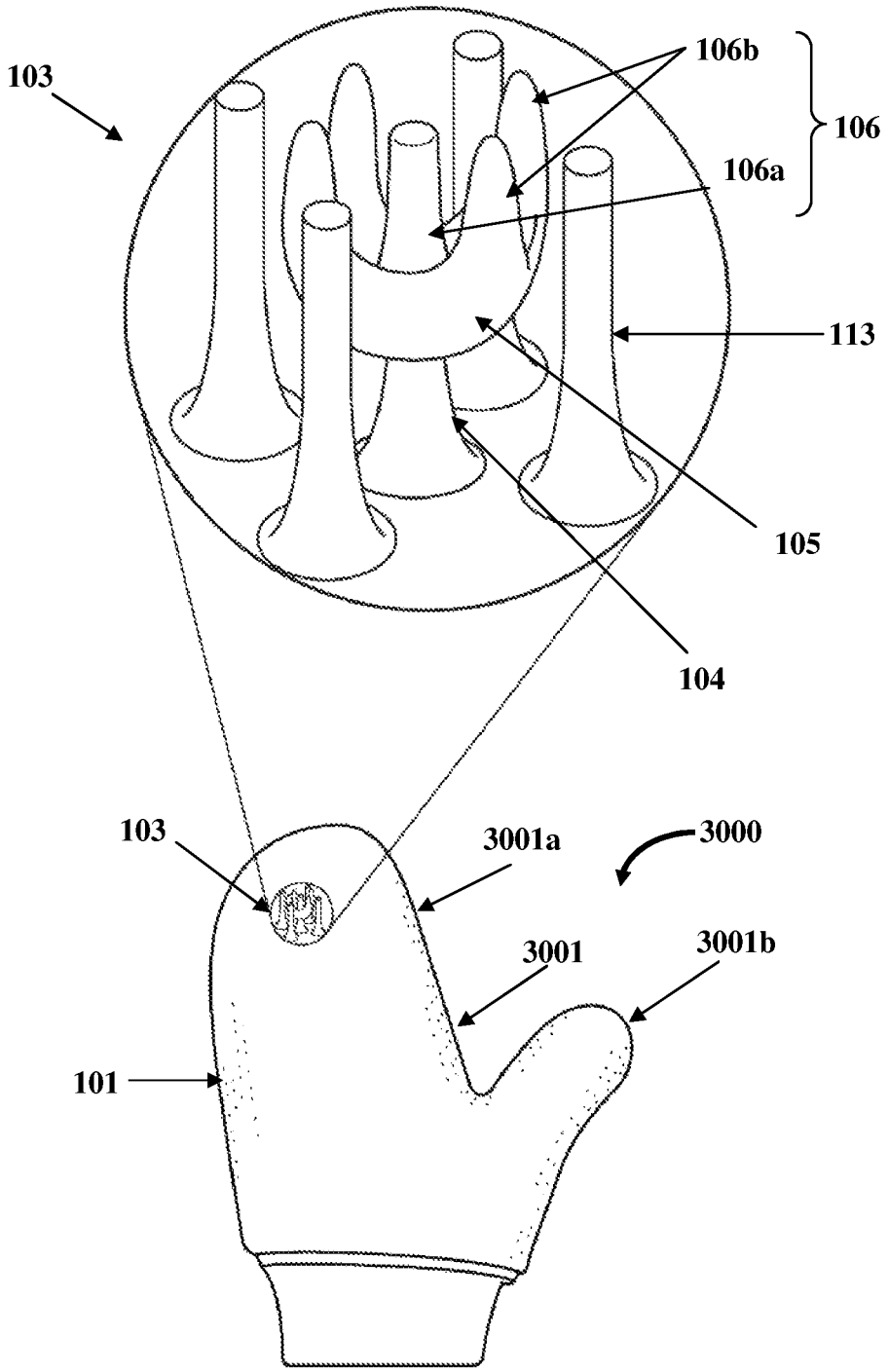
FIG. 30 exemplarily illustrates an embodiment of the body cleansing apparatus, showing the base member configured as a wearable unit that conforms to a hand of a user.

FIG. 30 exemplarily illustrates an embodiment of the body cleansing apparatus 3000, showing the base member 101 configured as a wearable unit 3001 that conforms to a hand of a user. The wearable unit 3001 is shaped, for example, as a mitten or a glove. In this embodiment, the wearable unit 3001 comprises a chamber 3002 for accommodating the user's hand. In an embodiment, the wearable unit 3001 comprises a single sheath 3001*a* for enclosing the user's fingers and a thumb sheath 3001*b* for enclosing the user's thumb. In another embodiment, the wearable unit 3001 comprises individual finger sheaths (not shown) for enclosing the user's fingers, and a thumb sheath 3001*b* for enclosing the user's thumb. In an embodiment, the wearable unit 3001 comprises a selectively textured surface with varying levels of texture. For example, the wearable unit 3001 may have a roughened texture to aid in exfoliation during cleansing, a medium texture for comfortable use during cleansing, a smooth texture for providing a smooth feel to the user, etc., depending upon the skin characteristics of the user. As exemplarily illustrated in FIG. 30, the single elongated flexible bristles 113 along with the clusters 105 of flexible bristles 106 are positioned and attached at multiple locations on the wearable unit 3001. The wearable unit 3001 allows the user to clean accessible parts of the user's body.

In an embodiment, the wearable unit 3001 comprises a loop element (not shown) for suspending or hanging the wearable unit 3001, for example, on a hook (not shown) on a support structure 2801, for example, a wall of a bathroom exemplarily illustrated in FIG. 28, when the wearable unit 3001 is not in use. The loop element may be stitched on the wearable unit 3001 or detachably attached to the wearable unit 3001.

Figure 31:
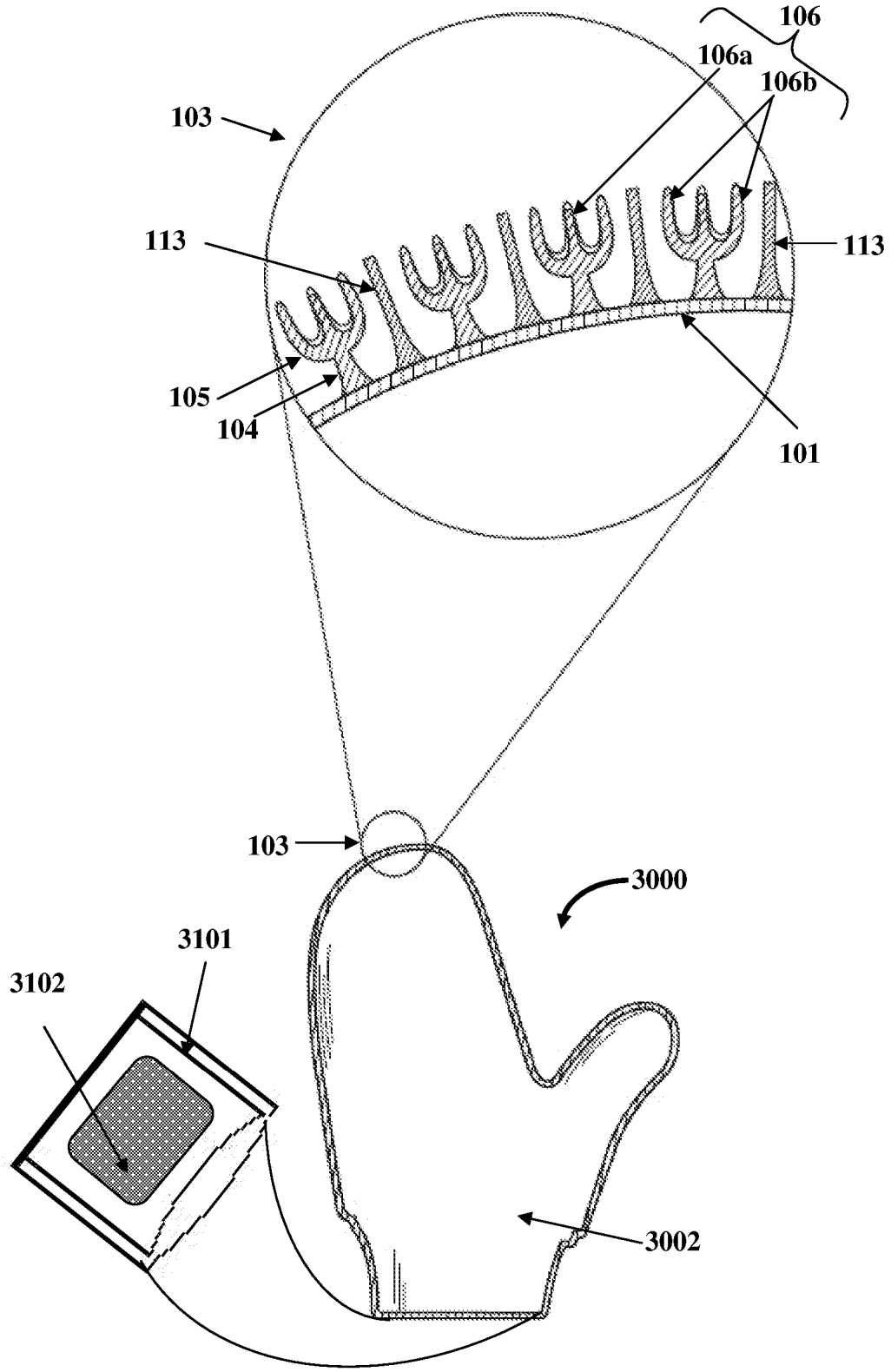
FIG. 31 exemplarily illustrates a sectional view of the embodiment of the body cleansing apparatus, showing an insert member extending outwardly from the wearable unit and containing a cleansing agent.

FIG. 31 exemplarily illustrates a sectional view of the embodiment of the body cleansing apparatus 3000, showing an insert member 3101 extending outwardly from the wearable unit 3001 and containing a cleansing agent 3102, for example, soap. The insert member 3101 is made of, for example, a breathable fabric. The insert member 3101 containing the cleansing agent 3102 is foldable into the chamber 3002 of the wearable unit 3001. The insert member 3101 is configured for right handed users and left handed users. The user inserts a hand into the chamber 3002 of the wearable unit 3001 and folds the insert member 3101 containing the cleansing agent 3102 into the chamber 3002 of the wearable unit 3001 for cleansing the user's body by release of the cleansing agent 3102 through the wearable unit 3001. In an embodiment, the wearable unit 3001 is selectively composed of a scrubbing material, for example, a spongy foam material. The cleansing agent 3102 permeates through the scrubbing material of the wearable unit 3001 for cleansing the user's body.

Figure 32:
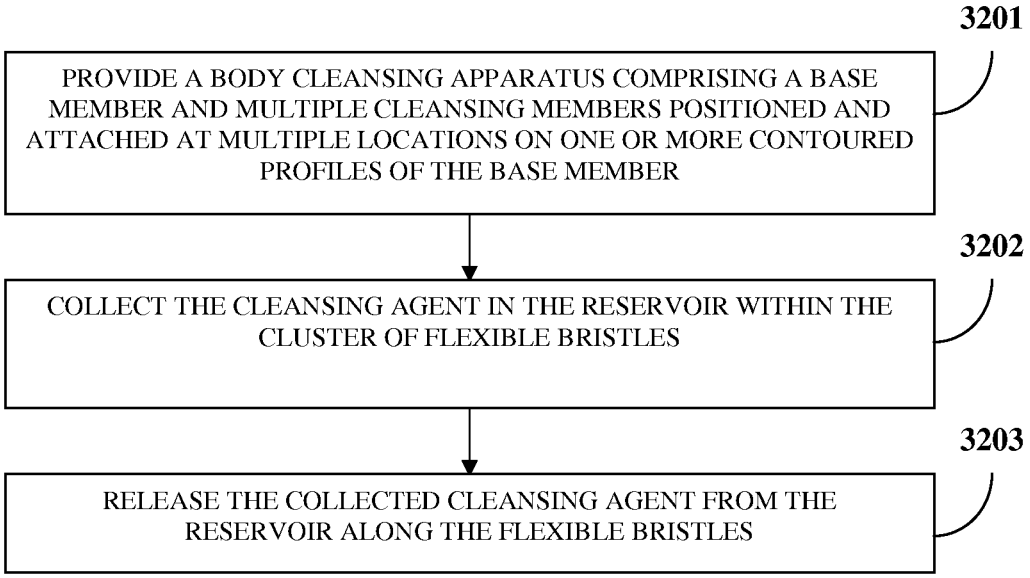
FIG. 32 exemplarily illustrates a method for cleansing a body part of a user.

FIG. 32 exemplarily illustrates a method for cleansing a body part of a user. A body cleansing apparatus 100 or 3000 comprising a base member 101 and a combination of single elongated flexible bristles 113 and clusters 105 of flexible bristles 106 positioned and attached at multiple locations on one or more contoured profiles 102*a* and 102*b* of the base member 101 as disclosed in the detailed description of FIGS. 1-31 is provided 3201. The cleansing agent 1001 is collected 3202 in the reservoir 110, exemplarily illustrated in FIGS. 12A-12B, FIG. 13, and FIGS. 15-16, within the cluster 105 of the flexible bristles 106 and 113. The collected cleansing agent 1001 is released 3203 from the reservoir 110 along the flexible bristles 106 and 113, when the user's body part contacts and applies pressure on the stem 104 for cleansing the body part. The flexible bristles 106 and 113 coated with the contained cleansing agent 1001 cleanse the user's body part when the user's body part contacts and applies pressure on the flexible bristles 106 and 113.

The flexibility and firmness of the flexible bristles 106 and 113 are controlled by the length of entasis or the contoured profiles 102*a* and 102*b* of the base member 101. The body cleansing apparatus 100 or 3000 is manufactured, for example, by an injection molding process. The thickness of the lower ends 104*b* and 113*b* of the stems 104 and the single elongated flexible bristles 113 and at the tips 106*c*, 106*d* and 113*a* of the flexible bristles 106 and 113 respectively, is controlled by controlling temperature of the dies and the characteristics of rubber or other flexible material used in manufacturing the flexible bristles 106 and 113. To expedite the process of manufacturing the body cleansing apparatus 100 or 3000, refrigerated dies driven by hydraulics and a programmable controller (not shown) are used, thereby enabling manufacture of at least one body cleansing apparatus 100 or 3000 every three seconds. In an embodiment, a manufacturing apparatus (not shown) is provided for manufacturing the body cleansing apparatus 100 or 3000 disclosed herein.

The body cleansing apparatus 100 or 3000 is cleaned, for example, using a dishwasher, a washing machine, etc. In an example, the body cleansing apparatus 100 can be detached from the support structure 2801 exemplarily illustrated in FIG. 28, rolled, and then placed in the dishwasher. The body cleansing apparatus 100 or 3000 may also be cleaned using a brush and hot water, while being attached to the support structure 2801.

In an embodiment, the body cleansing apparatuses 100 and 3000 exemplarily illustrated in FIG. 1 and FIG. 30 respectively are provided in a cleansing kit. The cleansing kit disclosed herein further comprises supplementary elements, for example, a non-slippage mat having a matt surface, cleansing agents 1001 and 3102, etc. The non-slippage mat provides grip to the user during cleansing. The non-slippage mat is positioned directly in front of the wall attached body cleansing apparatus 100 on a surface, for example, a base of a bath tub, where the user stands to prevent slippage during cleansing. The non-slippage mat is made of a slip resistant material and can be adhered to the base of the bath tub. The non-slippage mat prevents slippage of the user's feet during bathing. The user stands on the non-slippage mat with the user's back against the body cleansing apparatus 100 and performs an upward and downward movement against the flexible bristles 106 and 113 of the body cleansing apparatus 100 that branch outwardly from the base member 101. The cleansing kit is provided with cleansing apparatuses 100 and 3000 of different sizes and colors to suit the physical characteristics and preferences of multiple users.

Consider an example where a user utilizes the body cleansing apparatus 100 disclosed herein for cleansing the user's rear body part, that is, the user's back. The user attaches the body cleansing apparatus 100 comprising the base member 101 and multiple clusters 105 of flexible bristles 106 and the single elongated flexible bristles 113 to a support structure 2801, for example, a wall of a bathroom, for example, using hook and loop fasteners 115*a* and 2802*a* as disclosed in the detailed description of FIG. 28. The rear surface 101*c* of the base member 101 detachably attaches to the wall, while the front surface of the base member 101 with the outwardly extending flexible bristles 106 and 113 is exposed for cleansing the user. The user applies a cleansing agent 1001, for example, soap lather to the flexible bristles 106 and 113 that extend outwardly from the base member 101 of the body cleansing apparatus 100. The user may also push his/her back against the flexible bristles 106 and 113 to dispense the cleansing agent 1001 from the cavities 107 and 113*e* of each cleansing member 103 through the apertures 106*e*, 106*f* and 113*c*, 113*d* respectively. The user then leans the user's back against the flexible bristles 106 and 113 such that the contoured profiles 102*a* and 102*b* of the base member 101 that support the flexible bristles 106 and 113 conform to the posterior curvature of the user's back. When the user applies pressure on the flexible bristles 106, the cleansing agent 1001 is released from the reservoir 110 defined in each of the flexible bristles 106 onto the flexible bristles 106. On making contact with the flexible bristles 106 and 113, the user performs an upward movement and a downward movement of the user's back against the flexible bristles 106 and 113 coated with the released cleansing agent 1001 for cleansing the user's back. The user may also power the motor 2903 and trigger the rolling motion of the body cleansing apparatus 100 as disclosed in the detailed description of FIG. 29.

The user may also insert a hand into the chamber 3002 of the wearable unit 3001 of the body cleansing apparatus 3000 exemplarily illustrated in FIGS. 30-31, and fold the insert member 3101 containing the cleansing agent 3102 into the chamber 3002 of the wearable unit 3001 for cleansing the user's body by release of the cleansing agent 3102 through the wearable unit 3001. The body cleansing apparatuses 100 and 3000 allow the user to cleanse rear body parts and other body parts to avoid, for example, oil build up which leads to problems such as acne, itchiness, etc.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials, and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

We claim:

1. A body cleansing apparatus, comprising:

a base member comprising one or more contoured profiles configured to conform to a body part of a user; and a plurality of cleansing members positioned and attached at multiple locations on said one or more contoured profiles of said base member, wherein at least one of the plurality of cleansing members comprises:

a stem attached to and extending outwardly from said base member;

a cluster of flexible bristles, wherein said flexible bristles curvedly branch outwards from an upper end of said stem, wherein said cluster of said flexible bristles comprises:

a central flexible bristle extending from said upper end of said stem of said at least one of the plurality of cleansing members; and a plurality of radial flexible bristles surrounding said central flexible bristle;

said cluster of flexible bristles defining a reservoir within said cluster, said reservoir configurable for storing and retaining a cleansing agent and releasing said cleansing agent along said flexible bristles when said body part of said user contacts and applies pressure on said stem;

whereby said flexible bristles coated with said cleansing agent allow said user to cleanse said body part when said body part contacts and applies said pressure on said flexible bristles.

2. The body cleansing apparatus of claim 1, wherein each of one or more of said flexible bristles in said cluster comprises one or more apertures positioned on a body of said each of said one or more of said flexible bristles, wherein said one or more apertures are configured to dispense said cleansing agent contained within said stem of said at least one of the plurality of cleansing members.

3. The body cleansing apparatus of claim 1, wherein at least another one of said plurality of cleansing members comprises a single elongated flexible bristle attached to and extending outwardly from said base member.

4. The body cleansing apparatus of claim 1, wherein said base member is configured to conform to a rear said body part of said user for cleansing said rear said body part of said user.

5. The body cleansing apparatus of claim 4, wherein said base member configured for cleansing said rear said body part of said user is detachably attachable to a support structure by one or more fasteners.

6. The body cleansing apparatus of claim 1, wherein said at least one of the plurality of cleansing members is detachably attachable to one or more of said multiple locations on said one or more contoured profiles of said base member for allowing said user to flexibly configure said at least one of the plurality of cleansing members on said base member for said cleansing of said body part of said user.

7. The body cleansing apparatus of claim 1, wherein each of said flexible bristles comprises a flexible tip configured to contact and cleanse said body part of said user.

8. A body cleansing apparatus, comprising:

a base member comprising one or more contoured profiles configured to conform to a body part of a user; and a plurality of cleansing members positioned and attached at multiple locations on said one or more contoured profiles of said base member, wherein at least one of the plurality of cleansing members comprises:

a stem attached to and extending outwardly from said base member; and a cluster of flexible bristles, said flexible bristles curvedly branching outwards from an upper end of said stem and defining a reservoir within said cluster, said reservoir configurable for storing and retaining a cleansing agent;

a bladder within said base member, wherein said bladder is configured to store and contain said cleansing agent, wherein said stored cleansing agent is drawn from said bladder through said stem of said at least one of the plurality of cleansing members and out through one or more apertures positioned on a body of each of one or more of said flexible bristles in said cluster, when said body part of said user contacts and applies said pressure on said stem, for dispensing said cleansing agent;

whereby said flexible bristles coated with said cleansing agent allow said user to cleanse said body part when said body part contacts and applies said pressure on said flexible bristles.

9. A body cleansing apparatus, comprising:

a base member comprising one or more contoured profiles configured to conform to a body part of a user; and a plurality of cleansing members positioned and attached at multiple locations on said one or more contoured profiles of said base member, wherein at least one of the plurality of cleansing members comprises:

a stem attached to and extending outwardly from said base member; and a cluster of flexible bristles, wherein said cluster of said flexible bristles comprises:

a central flexible bristle extending from said upper end of said stem; and a plurality of radial flexible bristles surrounding said central flexible bristle, wherein said radial flexible bristles curvedly branch outwards from an upper end of said stem.

* * * * *